US010500868B2

(12) United States Patent
Horade et al.

(10) Patent No.: US 10,500,868 B2
(45) Date of Patent: Dec. 10, 2019

(54) LIQUID DISCHARGE APPARATUS HAVING TANK TO COMMUNICATE WITH CARTRIDGE TO BE ATTACHED IN THE APPARATUS

(71) Applicant: BROTHER KOGYO KABUSHIKI KAISHA, Nagoya-shi, Aichi-ken (JP)

(72) Inventors: Kenta Horade, Tokai (JP); Mikio Ogawa, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/155,527

(22) Filed: Oct. 9, 2018

(65) Prior Publication Data

US 2019/0105909 A1 Apr. 11, 2019

(30) Foreign Application Priority Data

Oct. 10, 2017 (JP) ..... 2017-197172

(51) Int. Cl.
*B41J 2/175* (2006.01)

(52) U.S. Cl.
CPC ..... *B41J 2/17566* (2013.01); *B41J 2/1752* (2013.01); *B41J 2/1753* (2013.01); *B41J 2/17509* (2013.01); *B41J 2/17513* (2013.01); *B41J 2/17546* (2013.01); *B41J 2/17553* (2013.01); *B41J 2002/17569* (2013.01); *B41J 2002/17573* (2013.01)

(58) Field of Classification Search
CPC ..... B41J 2/17566; B41J 2/17546; B41J 2/17553; B41J 2/17513; B41J 2/17509; B41J 2/1752; B41J 2/1753; B41J 2/17569; B41J 2/17573
See application file for complete search history.

(56) References Cited

U.S. PATENT DOCUMENTS

| | | | | |
|---|---|---|---|---|
| 2005/0185035 | A1 | 8/2005 | Takei | |
| 2006/0071952 | A1 | 4/2006 | Motominami et al. | |
| 2008/0204488 | A1 | 8/2008 | Usui | |
| 2009/0201351 | A1 | 8/2009 | Shimizu et al. | |
| 2009/0213181 | A1 | 8/2009 | Asauchi | |
| 2018/0281398 | A1 | 10/2018 | Iida et al. | |
| 2019/0105908 | A1* | 4/2019 | Ogawa | B41J 2/17523 |
| 2019/0193412 | A1* | 6/2019 | Horade | B41J 2/17566 |

FOREIGN PATENT DOCUMENTS

JP 2008-213162 A 9/2008

OTHER PUBLICATIONS

International Search Report and Written Opinion issued in related International Patent Application No. PCT/JP2018/037520, dated Jan. 8, 2019.

* cited by examiner

*Primary Examiner* — Lamson D Nguyen
(74) *Attorney, Agent, or Firm* — Merchant & Gould P.C.

(57) ABSTRACT

A liquid discharge apparatus includes an installation case, a tank, a memory and a controller. The installation case is to be attached a cartridge. The controller calculates total liquid amount Vt sum of a liquid amount Vc in a cartridge chamber and a liquid amount Vs in a chamber of the tank. The controller reads correlated information from memory, indicating a correspondence among the amount Vt and one of the amount Vc and the amount Vs. Based on the calculated amount Vt and the correlated information, the controller determines the amount Vc and the amount Vs.

17 Claims, 13 Drawing Sheets

LIQUID DISCHARGE APPARATUS HAVING TANK TO COMMUNICATE WITH CARTRIDGE TO BE ATTACHED IN THE APPARATUS

CROSS-REFERENCE TO RELATED APPLICATION

This application claims priority from Japanese Patent Application No. 2017-197172 filed on Oct. 10, 2017, the content of which is incorporated herein by reference in its entirety.

TECHNICAL FIELD

The present invention relates to a liquid discharge apparatus having a tank to communicate with a cartridge to be attached in the liquid discharge apparatus.

BACKGROUND

There has been known an inkjet printer that includes a detachably attachable main tank, a sub tank for storing ink supplied from the main tank attached to the inkjet printer, and an image recording unit for recording an image by ejecting ink stored in the sub tank (e.g., Japanese Laid-Open Patent Publication No. 2008-213162). An internal space of the main tank and an internal space of the sub tank each communicate with outside air. Therefore, in response to attachment of the main tank to the inkjet printer, ink moves such that a surface of ink stored in the main tank and a surface of ink stored in the sub tank become at the same level due to a hydraulic pressure difference between the internal space of the main tank and the internal space of the sub tank.

SUMMARY

As the image recording unit ejects ink, an amount of ink stored in each of the main tank and the sub tank changes. For example, when the cartridge becomes nearly empty of ink, it may be preferable to notify a user that a replacement of the cartridge is required. When the sub tank becomes nearly empty of ink, air entry into the image recording unit from the sub tank may need to be avoided. Therefore, it may be preferable to notify the user that the sub tank is nearly empty of ink, or it may be preferable to prohibit execution of image recording. Consequently, it may be preferable to obtain the amount of ink stored in each of the main tank and the sub tank.

The disclosure provides a liquid discharge apparatus including an installation case, a tank, a memory and a controller. The installation case is to be attached a cartridge. The controller calculates total liquid amount Vt sum of a liquid amount Vc in a cartridge chamber and a liquid amount Vs in a chamber of the tank. The controller reads correlated information from memory, indicating a correspondence among the amount Vt and one of the amount Vc and the amount Vs. Based on the calculated amount Vt and the correlated information, the controller determines the amount Vc and the amount Vs.

DETAILED DESCRIPTION

Figure 1A:
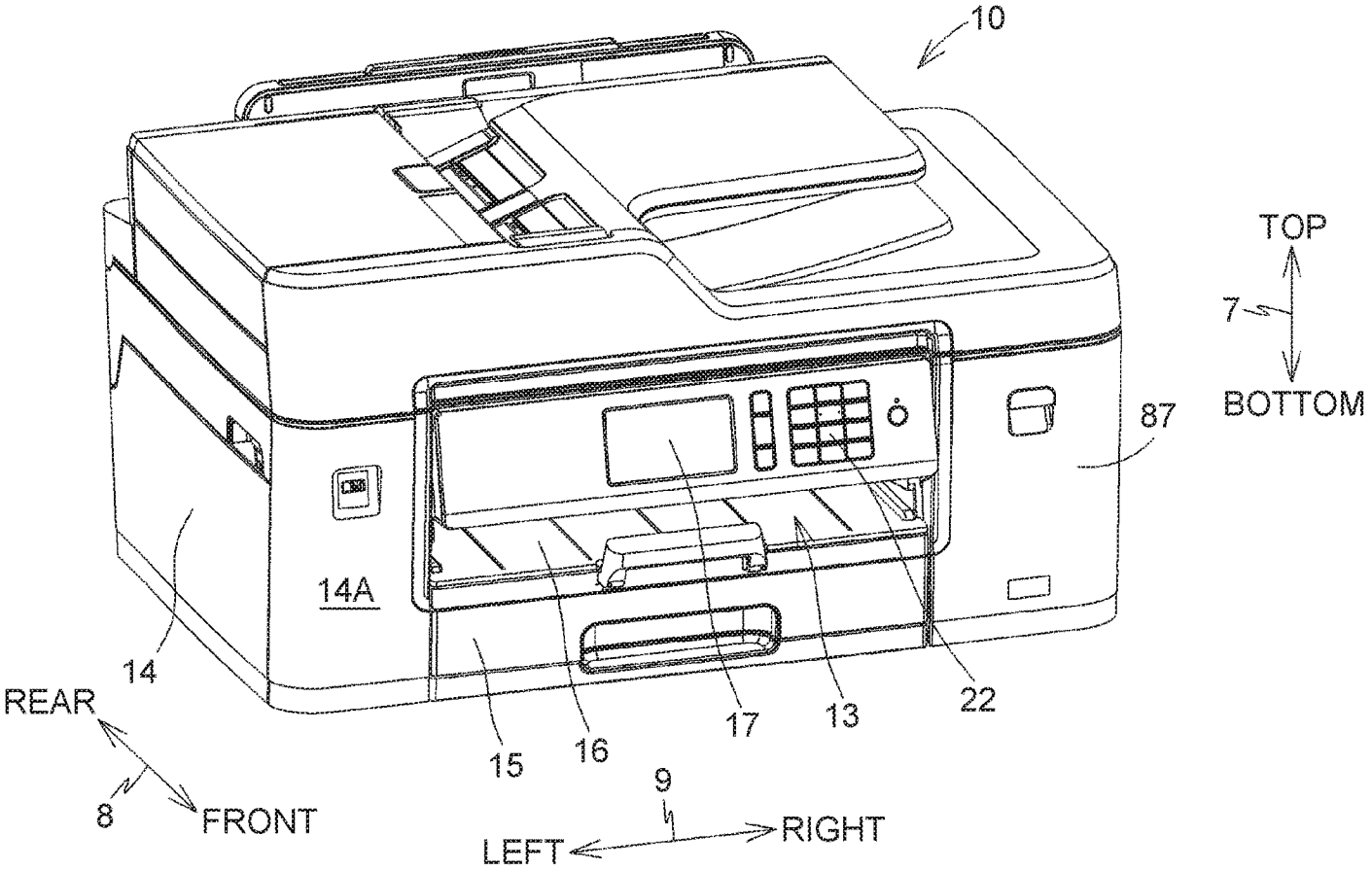
FIG. 1A is an appearance perspective view of a printer, wherein a cover is located at a covering position.

Hereinafter, an embodiment of the invention will be described. The embodiment disclosed below is merely an example. Various changes, arrangements and modifications may be applied therein without departing from the spirit and scope of the invention. A top-bottom direction 7 may be defined with reference to an orientation of a printer 10 that may be disposed in an orientation in which it may be intended to be used with being placed on a horizontal surface. A side of the printer 10, in which an opening 13 may be defined, may be defined as the front of the printer 10. A front-rear direction 8 may be defined with reference to the front of the printer 10. A right-left direction 9 may be defined with respect to the printer 10 as viewed from the front of the printer 10. In the embodiment, the top-bottom direction 7 corresponds to the vertical direction and the front-rear direction 8 and the right-left direction 9 each correspond to the horizontal direction when the printer 10 is disposed in the used orientation. The front-rear direction 8 and the right-left direction 9 are orthogonal to each other.

Overall Configuration of Printer 10

The printer 10 is an example of a liquid discharge apparatus that records an image onto a sheet using an inkjet recording method. The printer 10 includes a housing 14 having a rectangular parallelepiped shape. In other embodiments, for example, the printer 10 may be a multifunction device having multiple functions, for example, a facsimile transmission/reception function, a scanning function, and a copying function.

Figure 1B:
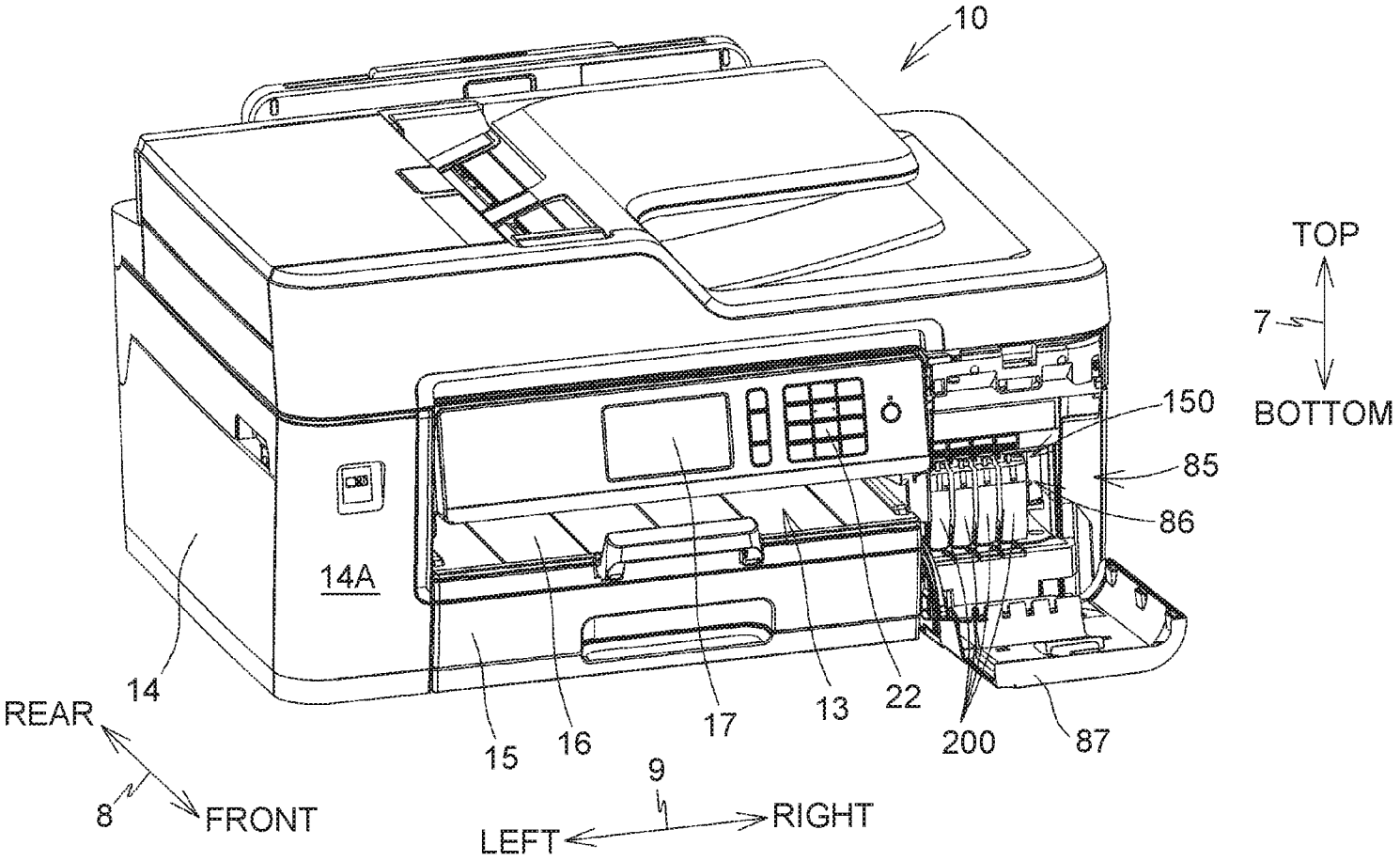
FIG. 1B is an appearance perspective view of the printer, wherein the cover is located at an uncovering position.
Figure 2:
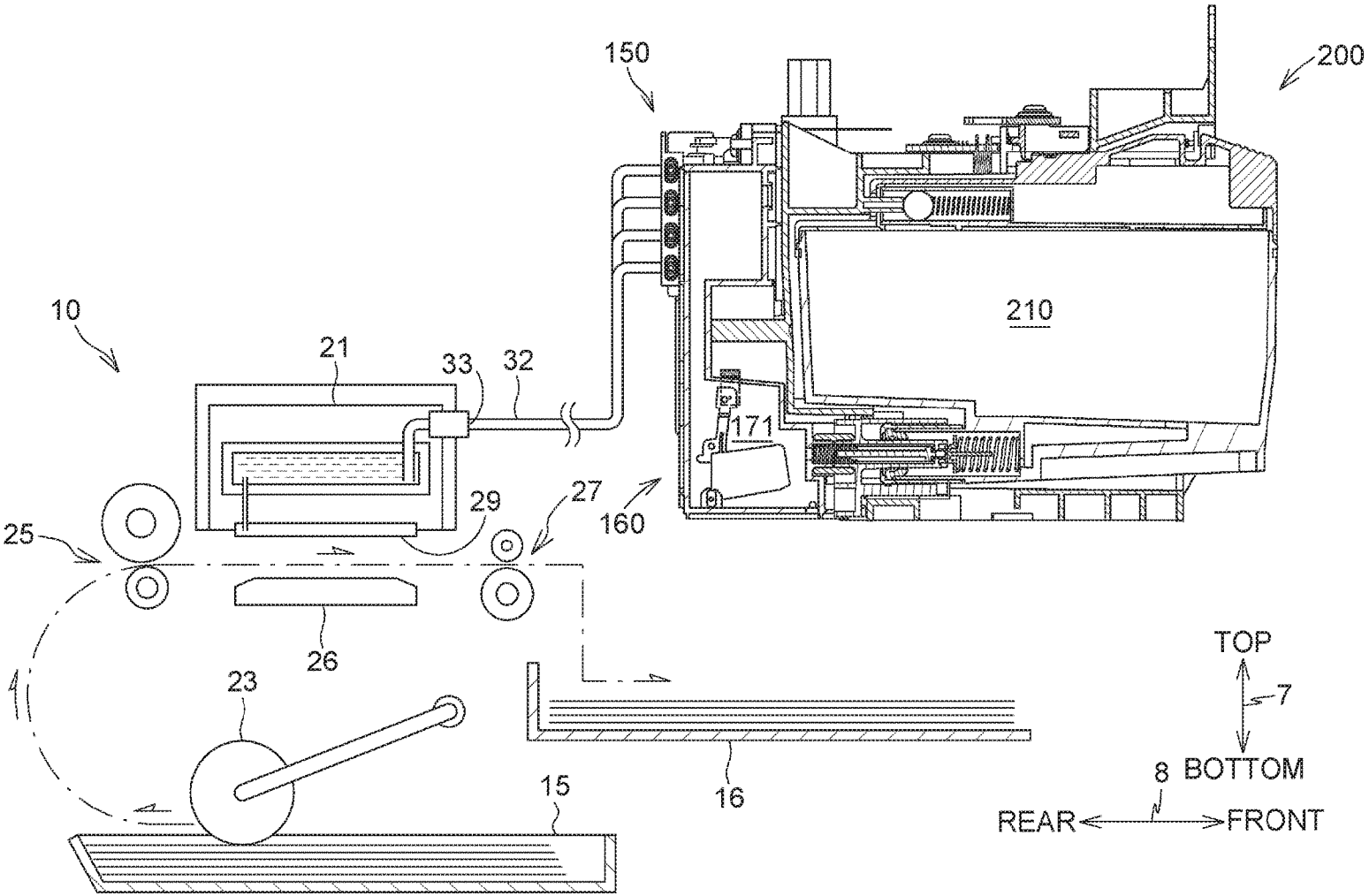
FIG. 2 is a schematic cross-sectional view illustrating an internal configuration of the printer.

As illustrated in FIGS. 1 and 2, the printer 10 further includes a feed tray 15, a feed roller 23, conveying rollers 25, a head 21, a platen 26, output rollers 27, an output tray 16, an installation case 150, and one or more tubes 32. The head 21 has a plurality of nozzles 29. The platen 26 is disposed facing the head 21. The installation case 150 is configured such that one or more cartridges 200 are attached to and detached from the installation case 150. The tube 32 provides communication between the head 21 and the cartridge 200.

The printer 10 causes the feed roller 23 and the conveying rollers 25 to be driven to convey a sheet onto the platen 26 from the feed tray 15. The printer 10 then causes the head 21 to eject ink, which is supplied from the cartridge 200 attached to the installation case 150 through the tube 32, through appropriate ones of the nozzles 29. Thus, the ejected ink droplets land on the sheet supported by the platen 26 and an image is recorded on the sheet. Thereafter, the printer 10 causes the output rollers 27 to be driven to output the sheet on which the image has been recorded, onto the output tray 16.

More specifically, the head 21 may be mounted on a carriage that reciprocates in a main scanning direction intersecting a sheet conveyance direction in which the conveying rollers 25 convey a sheet. In such a case, the printer 10 may cause the head 21 to eject ink through appropriate ones of the nozzles 29 while moving the carriage from one side to the other side with respect to the main scanning direction. Thus, a portion of the image may be recorded on a portion of the sheet facing the head 21. Thereafter, the printer 10 may cause the conveying rollers 25 to convey the sheet such that another portion of the sheet which is subjected to the next recording faces the head 21. By repeating recording and conveyance, the entire image may be recorded on the sheet.

In the embodiment, ink discharge from the nozzles 29 of the head 21 during image recording is referred to as "ejection". Nevertheless, ink discharge from the nozzles 29 of the head 21 during purging is not referred to as "ejection", but "ejection" is included in a concept of "discharge".

Cover 87

As illustrated in FIGS. 1A and 1B, the housing 14 has an opening 85 in its front surface 14A. The opening 85 is located at a right end portion of the housing 14 in the right-left direction 9. The housing 14 further includes a cover 87. The cover 87 is pivotable between a covering position at which the cover 87 closes the opening 85 (e.g., a position of the cover 87 in FIG. 1A) and an uncovering position at which the cover 87 exposes the opening 85 (e.g., a position of the cover 87 in FIG. 1B). The cover 87 is supported by a lower end portion of the housing 14 in the top-bottom direction 9 so as to be pivotable on an axis extending along the right-left direction 9. The housing 14 has an accommodating space 86 therein. The accommodating space 86 extends toward the rear from the opening 85 in the housing 14. The installation case 150 is disposed in the accommodating space 86.

Cover Sensor 88

Figure 6:
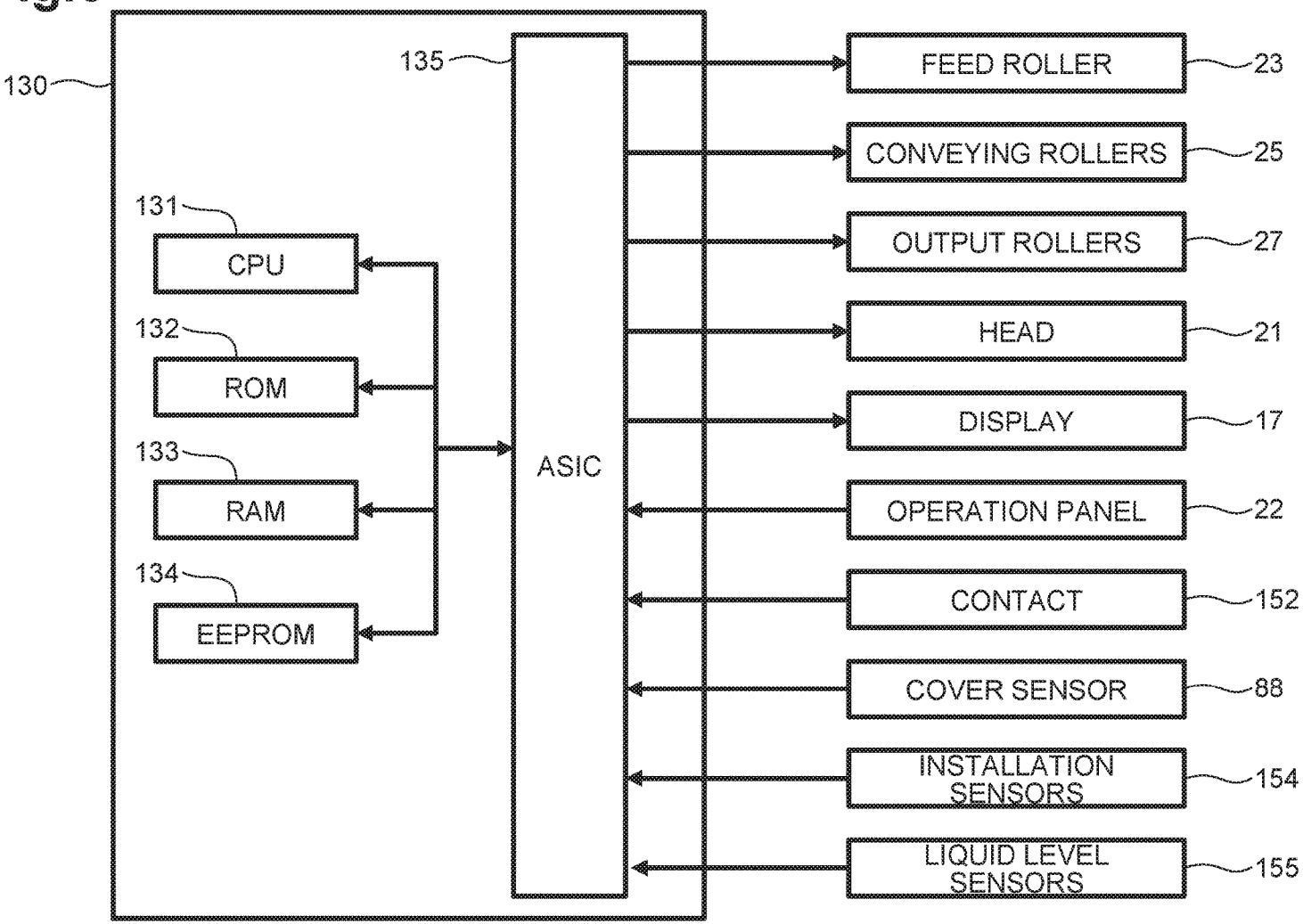
FIG. 6 is a block diagram of the printer.

The printer 10 further includes a cover sensor 88 (refer to FIG. 6). In one example, the cover sensor 88 may be a mechanical sensor such as a switch to and from which the cover 87 contacts and separates. In another example, the cover sensor 88 may be an optical sensor in which light may be blocked or unblocked in accordance with the position of the cover 87. The cover sensor 88 is configured to output a signal to a controller 130 in response to the position of the cover 87. More specifically, for example, the cover sensor 88 is configured to, in response to a detection that the cover 87 is located at the covering position, output a low level signal to the controller 130. On the other hand, the cover sensor 88 is configured to, in response to a detection that the cover 87 is located at a different position from the covering position, output a high level signal to the controller 130. In other words, the cover sensor 88 is configured to, in response to the detection that the cover 87 is located at the uncovering position, output a high level signal to the controller 130.

Installation Case 150

Figure 3:
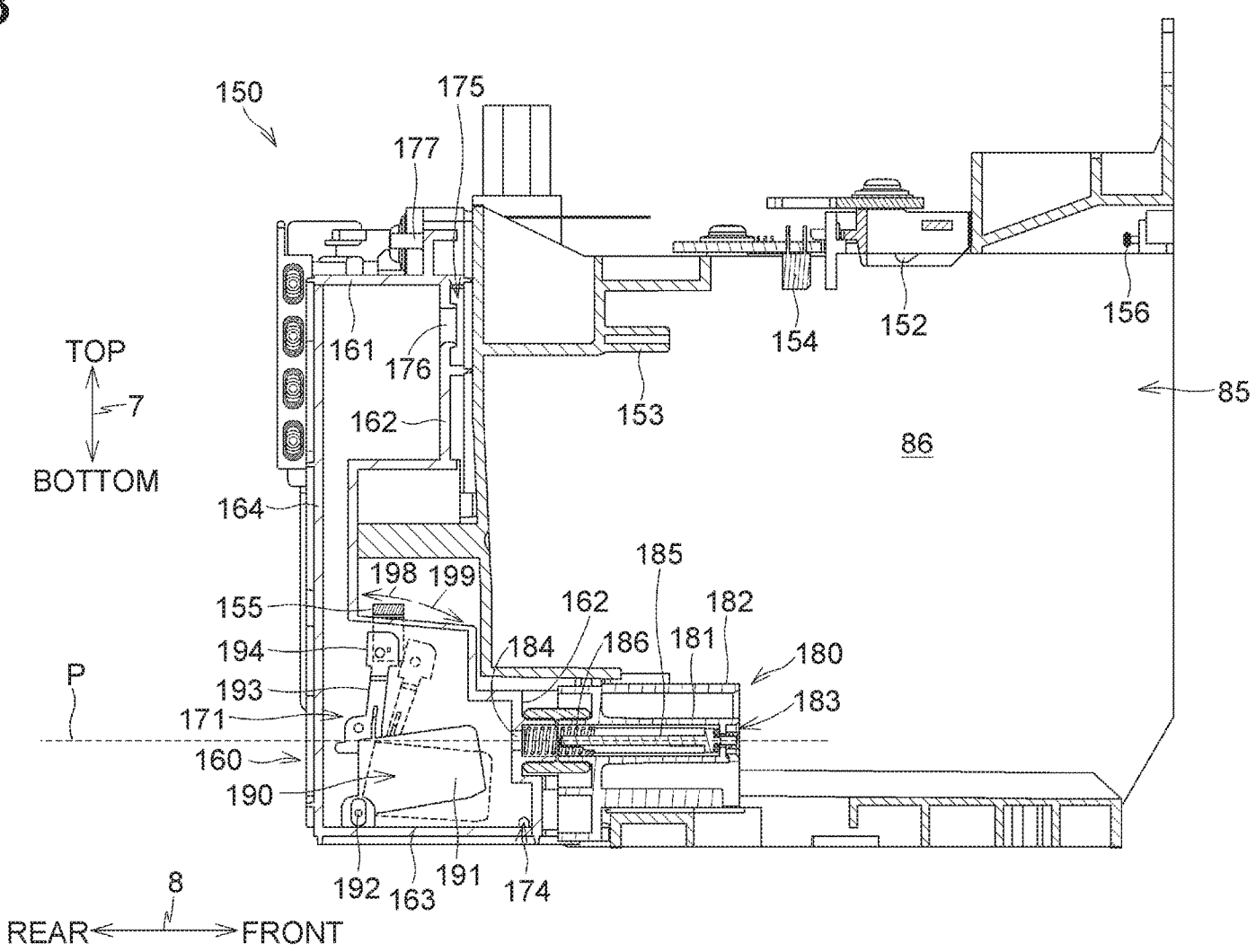
FIG. 3 is a cross sectional view of an installation case.

As illustrated in FIG. 3, the installation case 150 includes at least one each of a contact 152, a rod 153, an installation sensor 154, a liquid level sensor 155, and a lock pin 156. The installation case 150 is configured to accommodate four cartridges 200 corresponding to respective colors, e.g., black, cyan, magenta, and yellow. That is, the installation case 150 includes four each of the contact 152, the rod 153, the installation sensor 154, and the liquid level sensor 155. The number of cartridges 400 that the installation case 150 can accommodate therein is not limited to four, but may be one or five or more. Each of the contacts 152 is an example of an interface.

The installation case 150 has a box shape having an internal space for accommodating the cartridges 200. The internal space of the installation case 150 is defined by an upper wall defining an upper end of the internal space, a lower wall defining a lower end of the internal space, a rear wall defining a rear end of the internal space in the front-rear direction 8, and side walls defining right and left ends of the internal space in the right-left direction 9. The rear wall of the installation case 150 faces the opening 85. That is, when the cover 87 is located at the uncovering position, the opening 85 allows the internal space of the installation case 150 to be exposed to the outside of the printer 10.

Each of the cartridges 200 may be inserted into and detached from the installation case 150 through the opening 85 of the housing 14. More specifically, for example, when each of the cartridge 200 is attached to the installation case 150, each of the cartridges 200 enters the installation case 150 through the opening 85 by moving rearward in the front-rear direction 8. When each of the cartridge 200 is detached from the installation case 150, each of the cartridges 200 exits from the installation case 150 through the opening 85 by moving frontward in the front-rear direction 8.

Contacts 152

The contacts 152 are disposed at the upper wall of the installation case 150. The contacts 152 protrude downward toward the internal space of the installation case 150 from the upper wall of the installation case 150. Each of the contacts 152 is disposed so as to contact a plurality of electrodes 248 of a corresponding one of the cartridges 200 in a state where each of the cartridges 200 is fully attached to the installation case 150. Each of the contacts 152 has conductivity and is elastically deformable in the top-bottom direction 7. Each of the contacts 152 is electrically connected to the controller 130.

Rods 153

The rods 153 protrude frontward from the rear wall of the installation case 150. The rods 153 are disposed above joints 180 at the rear wall of the installation case 150. Each of the rods 153 is configured to, during attachment of each of the cartridges 200 to the installation case 150, enter a ventilation valve chamber 214 via a ventilation opening 221 of a corresponding one of the cartridges 200. In response to entry of the rod 153 into the ventilation valve chamber 214, the ventilation valve chamber 214 becomes communicated with outside air.

Installation Sensors 154

The installation sensors 154 are disposed at the upper wall of the installation case 150. Each of the installation sensors 154 enables the controller 130 to determine whether a corresponding one of the cartridges 200 is being fully attached to the installation case 150. Each of the installation sensors 154 includes a light emitter and a light receiver that are spaced apart from each other in the right-left direction 9. In a state where a cartridge 200 is attached to the installation case 150, a light blocking rib 245 of the cartridge 200 is located between a light emitter and a light receiver of a corresponding installation sensor 154. In other words, in such a state, the light emitter and the light receiver of the installation sensor 154 face each other while sandwiching the light blocking rib 245 of the cartridge 200 fully attached to the installation case 150.

Each of the installation sensors 154 is configured to output different signals (in FIG. 7, referred to as an "installation signal") depending on whether the light receiver has received light emitted from the light emitter in the right-left direction 9. For example, each of the installation sensors 154 is configured to, in response to a detection that intensity of light received by the light receiver is less than a threshold, output a low level signal to the controller 130. On the other hand, each of the installation sensors 154 is configured to, in a detection that intensity of light received by the light receiver is higher than or equal to the threshold, output a high level signal to the controller 130. The high level signal has a higher signal strength than the low level signal. The high level signal is an example of a third signal, and the low level signal is an example of a fourth signal.

Liquid Level Sensors 155

Each of the liquid level sensors 155 enables the controller 130 to determine whether a detector portion 194 of an actuator 190 is located at a detected position. Each of the liquid level sensors 155 includes a light emitter and a light receiver that are spaced apart from each other in the right-left direction 9. When the detector portion 194 is located at the detected position, the light emitter and the light receiver of the liquid level sensor 155 face each other while sandwiching the detector portion 194. Each of the liquid level sensors 155 is configured to output different signals (in FIG. 7, referred to as a "liquid level signal") depending on whether the light receiver has received light emitted from the light emitter. For example, each of the liquid level sensors 155 is configured to, in response to a detection that intensity of light received by the light receiver is less than a threshold, output a low level signal to the controller 130. On the other hand, each of the liquid level sensors 155 is configured to, in response to a detection that intensity of light received by the light receiver is higher than or equal to the threshold, output a high level signal to the controller 130. The high level signal has a higher signal strength than the low level signal. The high level signal is an example of a second signal, and the low level signal is an example of a first signal.

Lock Pin 156

The lock pin 156 is disposed in the internal space of the installation case 150. The lock pin 156 is located at an upper end portion of the installation case 150 and close to the opening 85. The lock pin 156 has a bar shape extending in the right-left direction 9. Both ends of the lock pin 156 in the right-left direction 9 are fastened to the side walls of the installation case 150. The lock pin 156 extends in the right-left direction 9 throughout all of four spaces capable of accommodating the respective four cartridges 200. The lock pin 156 is configured to retain each of the cartridges 200, which are fully attached to the installation case 150, at an attached position (refer to FIG. 5). In a state where each of the cartridges 200 is fully attached to the installation case 150, each of the cartridges 200 is engaged with the lock pin 156.

Tanks 160

The printer 10 further includes four tanks 160, which are provided for the respective cartridges 200. The tanks 160 are disposed further to the rear than the rear wall of the installation case 150. All of the tanks 160 have the same or similar configuration, and therefore, one of the tanks 160 will be described in detail. As illustrated in FIGS. 3, the tank 160 is defined by an upper wall 161, a lower wall 163, a rear wall 164, and side walls (not illustrated). The front wall 162 includes a plurality of walls that are located at different positions with respect to the front-rear direction 8. The tank 160 has a liquid chamber 171 therein.

Of the walls constituting the tank 160, at least the wall facing a corresponding liquid level sensor 155 is translucent or transparent to light. Thus, light emitted by the liquid level sensor 155 may pass through the wall that faces the liquid level sensor 155. A film may constitute at least a portion of the rear wall 164. In such a case, the film may have melted and stuck to end faces of the upper wall 161, the lower wall 163, and the side walls. The side walls of the tank 160 may be shared with the installation case 150 or may be provided separately from the side walls of the installation case 150. The tanks 160 adjacent to each other in the right-left direction 9 are partitioned by respective partition walls (not illustrated).

The liquid chamber 171 communicates with an ink channel (not illustrated) via an outlet 174. The outlet 174 has a lower edge that is defined by the lower wall 163 defining the lower end of the liquid chamber 171. The outlet 174 is located below the joint 180 (more specifically, for example, a lower edge of a through hole 184). The ink channel (not illustrated) communicated with the outlet 174 communicates with a corresponding tube 32 (refer to FIG. 2). Thus, the liquid chamber 171 communicates with the head 21 via the outlet 174, the ink channel, and the tube 32. That is, ink stored in the liquid chamber 171 is supplied to the head 21 via the outlet 174, the ink channel, and the tube 32. The ink channel and the tube 32 communicated with the outlet 174 is a channel whose one end (e.g., the outlet 174) communicates with the liquid chamber 171 and whose other end 33 (refer to FIG. 2) communicates with the head 21.

The liquid chamber 171 communicates with air via a ventilation chamber 175. More specifically, for example, the ventilation chamber 175 communicates with the liquid chamber 171 via a through hole 176 that penetrates the front wall 162 of the tank 160. The ventilation chamber 175 communicates with the outside of the printer 10 via a ventilation port 177 and a tube (not illustrated) connected to the ventilation port 177. That is, the ventilation chamber 175 is a channel whose one end (e.g., the through hole 176) communicates with the liquid chamber 171 and whose other end (e.g., the ventilation port 177) communicates with the outside of the printer 10. The ventilation chamber 175 communicates with outside air via the ventilation port 177 and the tube (not illustrated).

Joints 180

As illustrated in FIG. 3, each of the joints 180 (one of which is illustrated in FIG. 3) includes a needle 181 and a guide 182. The needle 181 may be a hollow cylinder having a channel therein. The needle 181 protrudes frontward from the front wall 162 defining the liquid chamber 171. The needle 181 has an opening 183 at its protruding end. An internal space of the needle 181 communicates with the liquid chamber 171 via the through hole 184 that penetrates the front wall 162 of the tank 160. That is, the needle 181 is a channel whose one end (e.g., the opening 183) communicates with the outside of the tank 160 and whose other end (e.g., the through hole 184) communicates with the liquid chamber 171. The guide 182 may be a hollow cylindrical member that surrounds the needle 181. The guide 182 protrudes frontward from the front wall 162 and has an opening at its protruding end.

In the internal space of the needle 181, a valve 185 and a coil spring 186 are disposed. The valve 185 is movable in the front-rear direction 8 between a closing position and an open position in the internal space of the needle 181. When the valve 185 is located at the closing position, the valve 185 closes the opening 183. When the valve 185 is located at the open position, the valve 185 opens the opening 183. The coil spring 186 urges the valve 185 in a direction in which the coil spring 186 moves the valve 185 from the open position to the closing position, i.e., toward the front.

Actuators 190

Each of the actuators 190 is disposed in each of the liquid chamber 171. The actuator 190 is supported by a support member (not illustrated) disposed in the liquid chamber 171 so as to be pivotable in a direction of an arrow 198 and in a direction of an arrow 199. The actuator 190 is pivotable between a position indicated by a solid line and a position indicated by a dashed line in FIG. 3. The actuator 190 is restricted in its further movement in the direction of the arrow 198 from the position indicated by the solid line by a stopper (not illustrated) (e.g., one of inner walls of the liquid chamber 171). The actuator 190 includes a float 191, a shaft 192, an arm 193, and the detector portion 194.

The float 191 may be made of material having a lower specific gravity than ink stored in the liquid chamber 171. The shaft 192 protrudes from right and left surfaces of the float 191 in the right-left direction 9. The shaft 192 is engaged with holes (not illustrated) of the support member by insertion. Thus, the actuator 190 is supported by the support member so as to be pivotable on the shaft 192. The arm 193 extends substantially upward from the float 191. The detector portion 194 is disposed at a protruding end of the arm 193. The detector portion 194 has a plate shape extending in both the top-bottom direction 7 and the front-rear direction 8. The detector portion 194 may be made of material that may block light outputted by the light emitter of the liquid level sensor 155 or have a color that may block the light.

When a surface level of ink stored in the liquid chamber 171 is higher than or equal to a predetermined level P, the actuator 190 that has moved in the direction of the arrow 198 due to a buoyant force of the float 191 is retained at the detected position (indicated by the solid line in FIG. 3) by the stopper. When the surface level of ink stored in the liquid chamber 171 is lower than the predetermined level P, the actuator 190 moves in the direction of the arrow 199 with the ink level lowering. Thus, the detector portion 194 moves to a position different from the detected position. That is, the detector portion 194 moves correspondingly to an amount of ink remaining in the liquid chamber 171.

The predetermined level P may be the same level as an axis of the needle 181 in the top-bottom direction 7 and the center of an ink supply port 234. The predetermined level P is indicated by an imaginary line extending in the horizontal direction in the drawings. Nevertheless, the predetermined level P is not limited to the specific example but may be any level unless being located higher than the outlet 174 in the top-bottom direction 7. In one example, the predetermined level P may be the same level as an upper edge or a lower edge of the internal space of the needle 181. In another example, the predetermined level P may be the same level as an upper edge or a lower edge of the ink supply port 234.

When the surface level of ink stored in the liquid chamber 171 is higher than or equal to the predetermined level P, the detector portion 194 blocks light outputted from the light emitter of the liquid level sensor 155. Thus, the light outputted from the light emitter does not reach the light receiver and the liquid level sensor 155 outputs a low level signal to the controller 130. When the surface level of ink stored in the liquid chamber 171 is lower than the predetermined level P, the detector portion 194 does not block light outputted from the light emitter of the liquid level sensor 155. Thus, the light outputted from the light emitter reaches the light receiver and the liquid level sensor 155 outputs a high level signal to the controller 130. That is, the controller 130 is capable of determining, based on a type of a signal outputted by the liquid level sensor 155, whether the surface level of ink stored in the liquid chamber 171 is higher than or equal to the predetermined level P.

Cartridges 200

Figure 4A:
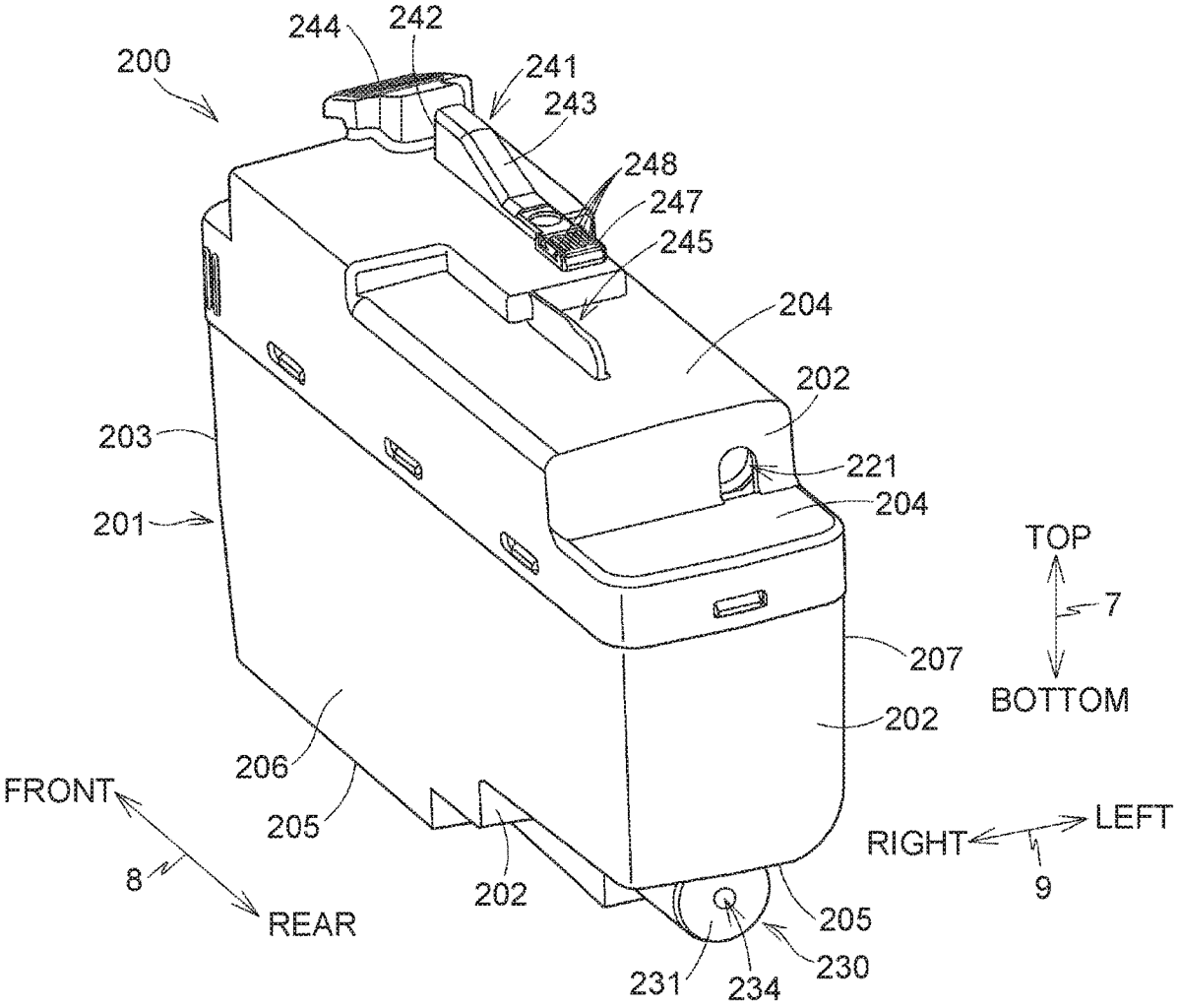
FIG. 4A is a front perspective view of a cartridge.

All of the cartridges 200 have the same or similar configuration, and therefore, the description will be provided with respect to one of the cartridges 200. The cartridge 200 may be a container having a liquid chamber 210 (refer to FIG. 2). The liquid chamber 210 is configured to store ink therein. Ink is an example of liquid. The liquid chamber 210 is defined by walls made of, for example, resin or plastic. As illustrated in FIG. 4A, the cartridge 200 has greater dimensions in the top-bottom direction 7 and in the front-rear direction 8 than a dimension in the right-left direction 9. In one example, the cartridges 200 storing respective different colors of ink may have the same external shape. In another example, the cartridges 200 storing respective different colors of ink may have different external shapes. At least one or more of the walls of the cartridge 200 is transparent or translucent to light. This configuration may therefore enable a user to confirm the amount or surface level of ink stored in the liquid chamber 210 of the cartridge 200.

The cartridge 200 includes a housing 201 and a supply tube 230. The housing 201 includes a rear wall 202, a front wall 203, an upper wall 204, a lower wall 205, and side walls 206 and 207. The rear wall 202 includes a plurality of walls that are located at different positions in the front-rear direction 8. The upper wall 204 includes a plurality of walls that are located at different positions in the top-bottom direction 7. The lower wall 205 includes a plurality of walls that are located at different positions in the top-bottom direction 7.

Figure 4B:
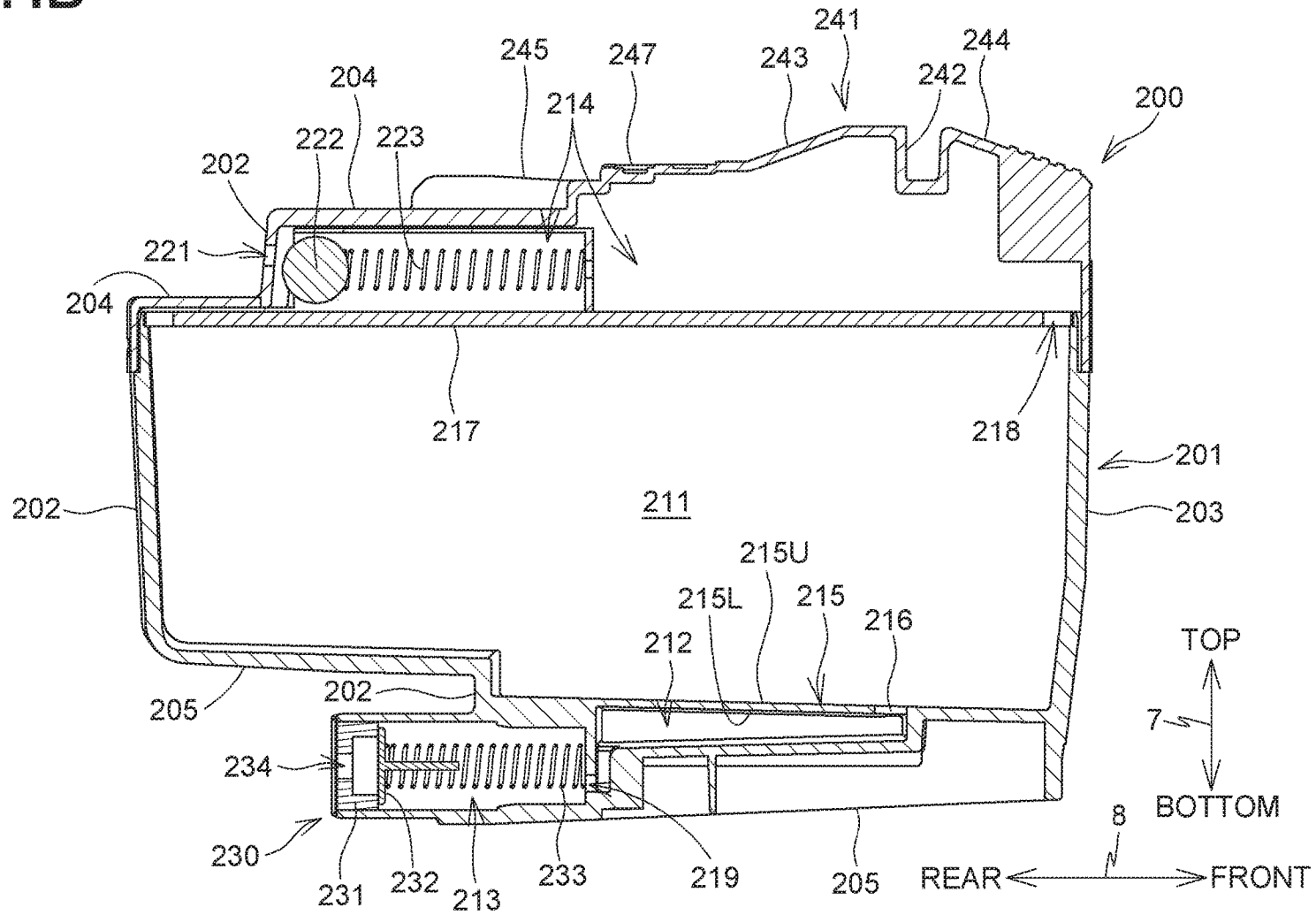
FIG. 4B is a cross sectional view of the cartridge.

As illustrated in FIG. 4B, the cartridge 200 includes the liquid chamber 210, an ink valve chamber 213, and the ventilation valve chamber 214. The liquid chamber 210 includes an upper liquid chamber 211 and a lower liquid chamber 212. The upper liquid chamber 211, the lower liquid chamber 212, and the ventilation valve chamber 214 may be internal spaces of the housing 210. The ink valve chamber 213 is an internal space of the supply tube 230. The liquid chamber 210 stores ink therein. The ventilation valve chamber 214 enables the liquid chamber 210 to communicate with the outside of the cartridge 200. The upper liquid chamber 211 is an example of a first portion, and the lower liquid chamber 212 is an example of a second portion.

A partition wall 215 (an example of a wall) is disposed for partitioning the inside of the housing 201. The upper liquid chamber 211 and the lower liquid chamber 212 of the liquid chamber 210 are partitioned by the partition wall 215 so as to be located one above the other in the top-bottom direction 7. The upper liquid chamber 211 and the lower liquid chamber 212 communicate with each other via a through hole 216 defined in the partition wall 215. Another partition wall 217 is disposed for further partitioning the inside of the housing 201. The upper liquid chamber 211 and the ventilation valve chamber 214 are partitioned by the partition wall 217 so as to be located one above the other in the top-bottom direction 7. The partition wall 215 has an upper surface 215U (an example of a first surface) defining a portion of the upper liquid chamber 211. The partition wall 215 has a lower surface 215L (an example of a second surface) defining a portion of the lower liquid chamber 212. The upper liquid chamber 211 and the ventilation valve chamber 214 communicate with each other via a through hole 218 defined in the partition wall 217. The ink valve chamber 213 communicates with a lower end of the lower liquid chamber 212 via a through hole 219.

The ventilation valve chamber 214 communicates with the outside of the cartridge 200 via the ventilation opening 221 defined in the rear wall 202 at an upper portion of the cartridge 200. That is, the ventilation valve chamber 214 is a channel whose one end (e.g., the through hole 218) communicates with the liquid chamber 210 and whose other end (e.g., the ventilation opening 221) communicates with the outside of the cartridge 200. The ventilation valve chamber 214 may communicate with outside air via the ventilation opening 221. A valve 222 and a coil spring 223 are disposed in the ventilation valve chamber 214. The valve 222 is movable in the front-rear direction 8 between a closing position and an open position. When the valve 222 is located at the closing position, the valve 222 closes the ventilation opening 221. When the valve 222 is located at the open position, the valve 222 opens the ventilation opening 221. The coil spring 223 urges the valve 222 in a direction in which the coil spring 223 moves the valve 222 from the open position to the closing position, i.e., toward the rear.

During attachment of the cartridge 200 to the installation case 150, the rod 153 enters the ventilation valve chamber 214 via the ventilation opening 221 of the cartridge 200. The rod 153 entering the ventilation valve chamber 214 moves the valve 222 toward the front from the closing position against the urging force of the coil spring 223. The movement of the valve 222 to the open position allows the upper liquid chamber 211 to communicate with outside air. The configuration for opening the ventilation opening 221 is not limited to the specific example. In other embodiments, for example, the ventilation opening 221 may be closed by a film, and the rod 153 may penetrate the film of the ventilation opening 221.

The supply tube 230 protrudes rearward from the rear wall 202 at a lower portion of the housing 201. The supply tube 230 has an opening at its protruding end (i.e., a rear end). That is, the air valve chamber 213 enables the liquid chamber 210 communicated therewith via the through hole 219 to communicate with the outside of the cartridge 200. The air valve chamber 213 is a channel whose one end (e.g., the through hole 219) communicates with the liquid chamber 210 (more specifically, the lower liquid chamber 212) and whose other end (e.g., the ink supply port 234) communicates with the outside of the printer 200. A sealer 231, a valve 232, and a coil spring 233 are disposed in the ink valve chamber 213.

The sealer 231 has the ink supply port 234 in the center thereof. The ink supply port 234 penetrates the sealer 231 in the front-rear direction 8. The ink supply port 234 has an inside diameter slightly smaller than an outside diameter of the needle 81. The valve 232 is movable in the front-rear direction 8 between a closing position and an open position. When the valve 232 is located at the closing position, the valve 232 contacts the sealer 231 to close the ink supply port 234. When the valve 232 is located at the open position, the valve 232 is spaced from the sealer 231 to open the ink supply port 234. The coil spring 233 urges the valve 232 in a direction in which the coil spring 223 moves the valve 222 from the open position to the closing position, i.e., toward the rear. The coil spring 233 has a greater urging force than the coil spring 186.

During attachment of the cartridge 200 to the installation case 150, the supply tube 230 enters the inside of the guide 182 and then the needle 181 enters the ink valve chamber 213 via the ink support port 234. At that time, the needle 181 fluid-tightly contacts an inner circumferential surface of the ink supply port 234 while elastically deforming the sealer 231. As the cartridge 200 is further moved into the installation case 150, the needle 181 moves the valve 232 toward the front against the urging force of the coil spring 233. In response, the valve 232 moves the valve 185, which protrudes from the opening 183 of the needle 181, toward the rear against the urging force of the coil spring 186.

Figure 5:
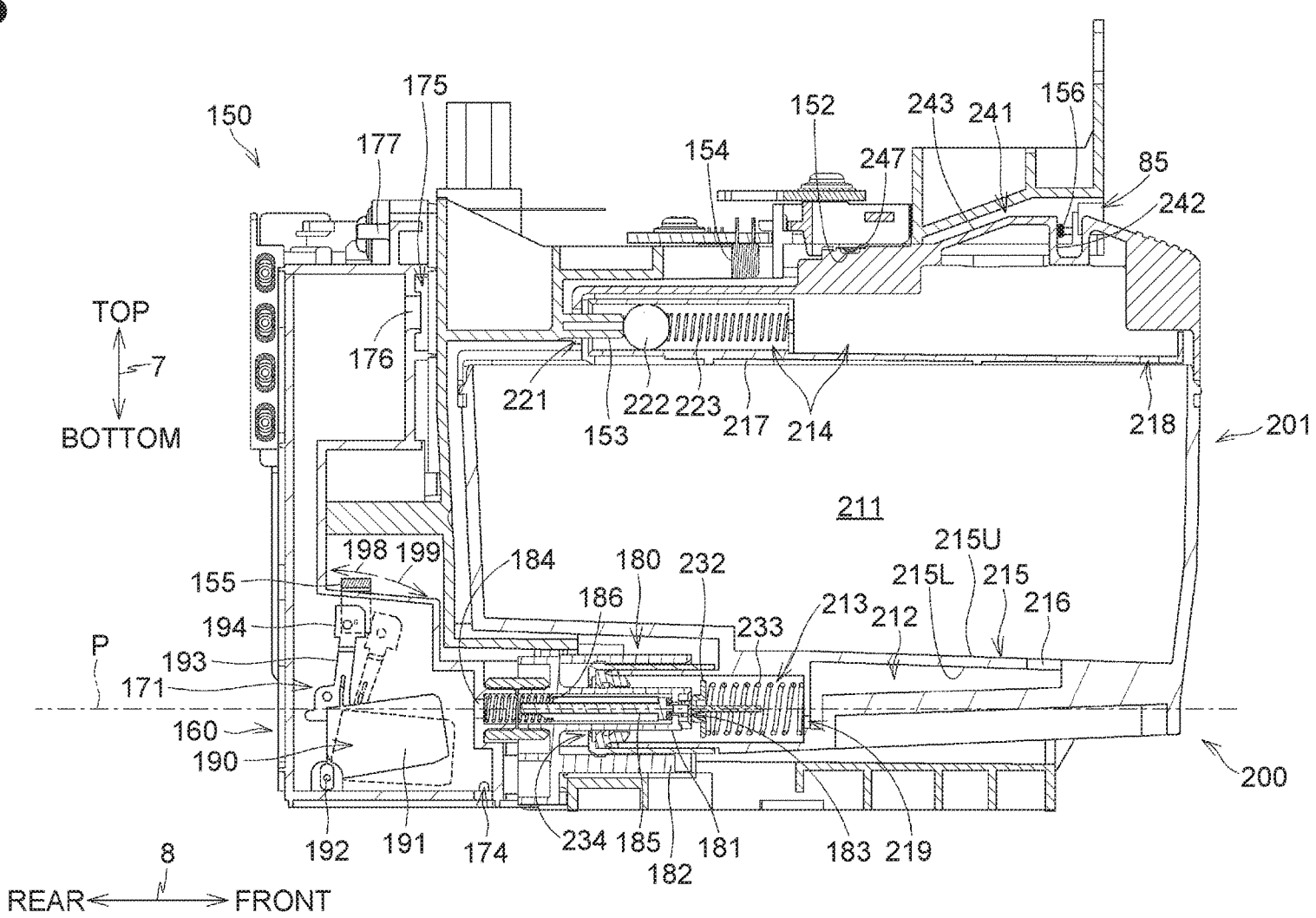
FIG. 5 is a cross sectional view of the cartridge fully attached to the installation case 150.

Thus, as illustrated in FIG. 5, the ink supply port 234 and the opening 183 are opened, thereby providing communication between the ink valve chamber 213 of the supply tube 230 and the internal space of the needle 181. That is, in a state where the cartridge 200 is fully attached to the installation case 150, the ink valve chamber 213 and the internal space of the needle 181 constitute a channel that may provide communication between the liquid chamber 210 of the cartridge 200 and the liquid chamber 171 of the tank 160.

Further, in such a state, the liquid chamber 210 and the liquid chamber 171 partially overlap each other as viewed in the horizontal direction. This configuration may therefore enable the ink stored in the liquid chamber 210 to move to the liquid chamber 171 of the tank 160 via the supply tube 230 and the joint 180, which connected to each other, due to a hydraulic pressure difference therebetween.

As illustrated in FIGS. 4A and 4B, the upper wall 204 of the cartridge 200 includes a protrusion 241. The protrusion 241 protrudes upward from an exterior surface of the upper wall 204 and is elongated in the front-rear direction 8. The protrusion 241 includes a lock surface 242 and an inclined surface 243. The lock surface 242 and the inclined surface 243 are located above the upper wall 204. The lock surface 242 faces toward the front in the front-rear direction 8 and extends in both the up-down direction 7 and the right-left direction 9. The inclined surface 243 is angled relative to the upper wall 204 and faces upwardly rearward.

In a state where the cartridge 200 is fully attached to the installation case 150, the lock surface 242 contacts the lock pin 156. During attachment of the cartridge 200 to the installation case 150, the inclined surface 243 guides the lock pin 156 to a position where the lock pin 156 contacts the lock surface 242. In a state where the lock surface 242 and the lock pin 156 contact with each other, the cartridge 200 is retained at the attached position (refer to FIG. 5) against the urging force of each of the coil springs 186, 223, and 233.

The cartridge 200 further includes a plate-shaped member that is disposed further to the front than the lock surface 42. The plate-shaped member extends upward from the upper wall 204. The plate-shaped member has an upper surface that may be an operable portion 244 to be used by a user for detaching the cartridge 200 from the installation case 150. In a state where the cartridge 200 is fully attached to the installation case 150 and the cover 87 is located at the uncovering position, the operable portion 244 may be accessed by the user. As the operable portion 244 is pressed downward, the cartridge 200 rotates and the lock surface 242 moves to below the lock pin 156. Thus, the cartridge 200 is allowed to be detached from the installation case 150.

The cartridge 200 further includes the light blocking rib 245 at the exterior surface of the upper wall 204. The light blocking rib 245 is disposed further to the rear than the protrusion 241. The light blocking rib 245 protrudes upward from the exterior surface of the upper wall 204 and is elongated in the front-rear direction 8. The light blocking rib 245 may be made of material that may block light outputted by the light emitter of the installation sensor 154 or have a color that may block the light. In a state where the cartridge 200 is attached to the installation case 150, the light blocking rib 245 is located on an path in which light emitted from the light emitter travels to the light receiver. That is, the installation sensor 154 is configured to, in response to a detection that a corresponding cartridge 200 is attached to the installation case 150, output a low level signal to the controller 130. On the other hand, the installation sensor 154 is configured to, in response to a detection that a corresponding cartridge 200 is not attached to the installation case 150, output a high level signal to the controller 130. That is, the controller 130 is capable of determining, based on a type of a signal outputted by the installation sensor 154, whether a corresponding cartridge 200 is attached to the installation case 150.

The cartridge 200 further includes an IC board 247 at the exterior surface of the upper wall 204. The IC board 247 is disposed between the light blocking rib 245 and the protrusion 241 in the front-rear direction 8. The IC board 247 includes the plurality of electrodes 248. The IC board 247 further includes a memory (not illustrated). The electrodes 248 are electrically connected to the memory of the IC board 247. The electrodes 248 are exposed at an upper surface of the IC board 247 and are capable of electrically connecting the contact 152. That is, in a state where the cartridge 200 is fully attached to the installation case 150, the electrodes 248 are electrically continuous to the contact 152. The controller 130 is configured to read and write various information from and into the memory of the IC board 247 via the contact 152 and the electrodes 248.

The memory of the IC board 247 stores an ink amount Vc and individual identifying information identifying the cartridge 200. For a completely new cartridge 200, a memory of its IC board 247 stores an initial ink amount Vc0 as the ink amount Vc. The initial ink amount Vc0 indicates an amount of ink stored in a completely new cartridge 200. The completely new cartridge 200 refers to a cartridge 200 that has not been used yet before and that has not yet allowed ink to flow out from the cartridge 200 after manufactured and sold.

The memory of the IC board 247 has, for example, an unrewritable area in which information is not rewritable by the controller 130 and a rewritable area in which information is rewritable by the controller 130. For example, the identifying information is stored in the unrewritable area, and the ink amount Vc is stored in the rewritable area.

Controller 130

As illustrated in FIG. 6, the controller 130 includes a CPU 131, a ROM 132, a RAM 133, an EEPROM 134, and an ASIC 135. The ROM 132 stores a program used by the CPU 131 for controlling various operations. The RAM 133 is used as a storage area for temporality storing data and/or signals to be used by the CPU 1331 during execution of the program, and also as a working area for processing data. The EEPROM 134 stores setting information that needs to be retained after power of the printer 10 is turned off. The ROM 132, the RAM 133, and the EEPROM 134 are an example of a memory.

The ASIC 135 is used for activating the feed roller 23, the conveying rollers 25, the output rollers 27, and the head 21. The controller 130 is configured to control the ASIC 135 to drive a motor (not illustrated) to rotate the feed roller 23, the conveying rollers 25, and the output rollers 27. The controller 130 is further configured to control the ASIC 135 to output a drive signal to a drive element of the head 21 to eject ink from the head 21 via one or more of the nozzles 29. The ASIC 135 is configured to output various drive signals in accordance with an amount of ink to be ejected via each of the nozzles 29.

The printer 10 further includes a display 17 and an operation panel 22, each of which is connected to the ASIC 135. The display 17 may be, for example, a crystal liquid display or an organic electroluminescent display. The display 17 includes a screen for displaying various information. The display 17 is an example of an alarm. Nevertheless, the notification device is not limited to the display 17. In other embodiments, for example, the notification device may be a speaker, an LED lamp, or a combination of the speaker and the LED lamp. The operation panel 22 is configured to output an operation signal to the controller 130 in response to a user operation. The operation panel 22 may include, for example, a pressing button or a touch sensor laminated on the display 17.

The contacts 152, the cover sensor 88, the installation sensors 154, the liquid level sensors 155 are also each connected to the ASIC 135 electrically. The controller 130 is configured to access the memory of the IC board 247 of the cartridge 200 fully attached to the installation case 150. The controller 130 is configured to detect the position of the cover 87 via the cover sensor 88. The controller 130 is further configured to determine, via the installation sensor 154, whether a corresponding cartridge 200 is attached or not. The controller 130 is further configured to determine whether the surface level of ink stored in the liquid chamber 171 is higher than or equal to the predetermined level P.

The ROM 132 stores a predetermined ink amount Vsc and a predetermined ink amount Vcc. The predetermined ink amount Vsc refers to a predetermined amount of ink stored in the liquid chamber 171 of the tank 160 when a corresponding liquid level sensor 155 outputs a high level signal. The predetermined ink amount Vcc refers to a predetermined amount of ink stored in the liquid chamber 210 of the cartridge 200 when the corresponding liquid level sensor 155 outputs a high level signal. In the embodiment, the predetermined ink amount Vcc may be zero.

The EEPROM 134 stores various information in association with the respective four cartridges 200 to be attached to the installation case 150, i.e., in association with the respective tanks 160 with which the respective cartridges 200 communicate. The various information includes, for example, the ink amount Vc (an example of a liquid amount), the ink amount Vs (another example of the liquid amount), a function F1, a function F2, a C_Empty flag, an S_Empty flag, a count value SN, a count value TN, and a threshold $N_{th}$.

The ink amount Vc and the identifying information may be read by the controller 130 from the memory of the IC board 247 via the contact 152 in a state where the cartridge 200 is fully attached to the installation case 150. Nevertheless, in other embodiments, for example, the function F1 and the function F2 may be stored in the ROM 132 instead of the EEPROM 134.

The ink amount Vc indicates an amount of ink stored in the liquid chamber 210 of the cartridge 200. The ink amount Vs indicates an amount of ink stored in the liquid chamber 171 of the tank 160. The ink amount Vc and the ink amount Vs are calculated using appropriate one of the function F1 and the function F2.

The function F1 and the function F2 may be information that indicates a correspondence among a total ink amount Vt and the ink amount Vs. Ink stored in the liquid chamber 210 of the cartridge 200 and ink stored in the liquid chamber 171 of the tank 160 are in equilibrium while the surface of ink stored in the liquid chamber 210 and the surface of ink stored in the liquid chamber 171 are at the same level in the top-bottom direction 7. That is, when equilibrium is reached, ink stops moving between the liquid chamber 210 of the cartridge 200 and the liquid chamber 171 of the tank 160. A relationship between the total ink amount Vt and the ink amount Vs in equilibrium may be expressed by an approximation in which an actual measured value is approximated by a function.

Figure 9:
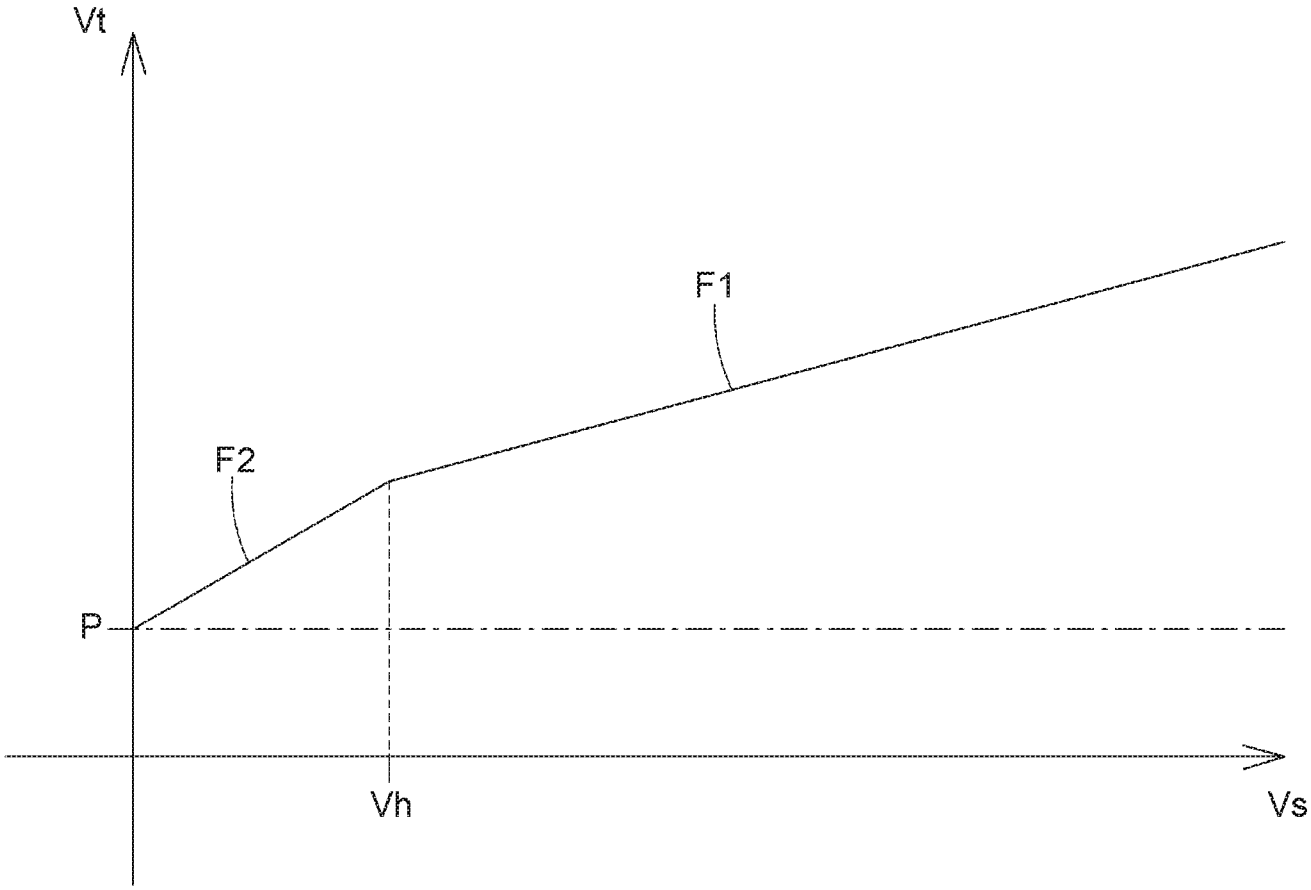
FIG. 9 is a diagram showing functions F1 and F2.

As illustrated in FIG. 9, the relationship of the ink amount Vs relative to the total ink amount Vt may be expressed approximately using the functions F1 and F2. The function F1 indicates the relationship of the ink amount Vs relative to the total ink amount Vt when the total ink amount Vt is greater than or equal to a threshold Vh. For example, Vs=a*Vt+b ("a" and "b" are constants). The function F2 indicates the relationship of the ink amount Vs relative to the total ink amount Vt when the total ink amount Vt is lower than the threshold Vh. For example, Vs=c*Vt+d ("c" and "d" are constants). The function F1 is an example of a first function and an example of correlated information. The function F2 is an example of a second function and an example of correlated information.

The threshold Vh indicates a value that corresponds to the total ink amount Vt when the surface of ink stored in the liquid chamber 210 of the cartridge 200 contacts the upper surface 215U or the lower surface 251L of the partition wall 215. Therefore, when the surface level of ink stored in the liquid chamber 210 of the cartridge 200 is higher than the partition wall 215, i.e., when the total ink amount Vt is greater than or equal to the threshold Vh, the ink amount Vs is calculated using the function F1. When the surface level of ink stored in the liquid chamber 210 of the cartridge 200 contacts the partition wall 215 or lower than the partition wall 215, i.e., when the total ink amount Vt is smaller than the threshold Vh, the ink amount Vs is calculated using the function F2. The ink amount Vc is calculated by subtraction of the ink amount Vs from the total ink amount Vt. The threshold Vh is an example of a first threshold.

The count value SN indicates a value corresponding to an ink discharge amount Dh (i.e., an ink amount indicated by a drive signal) which is instructed to the head 21 to discharge after a signal outputted by the liquid level sensor 155 has changed from the low level signal to the high level signal. The count value SN is updated to approach to a threshold $N_{th}$. The count value SN increases and its initial value may be 0 (zero). The threshold $N_{th}$ corresponds to a volume of a portion of the liquid chamber 171 between the upper edge of the outlet 174 and the predetermined level P. Nevertheless, in other embodiments, for example, the count value SN may decrease. In such a case, the initial value of the count value SN may be a value corresponding to the volume, and the threshold $N_{th}$ may be 0 (zero). The count value SN is an example of a second count value.

The count value TN indicates a value corresponding to an ink discharge amount Dh (i.e., an ink amount indicated by a drive signal) which is instructed to the head 21 to discharge after a signal outputted by the installation sensor 154 has changed from the high level signal to the low level signal. The count value TN increases and its initial value may be "0 (zero)". Nevertheless, in other embodiments, for example, the count value TN may decrease. In such a case, the initial value of the count value TN may be a value corresponding to the total ink amount Vt. The count value TN is an example of a first count value.

The C_Empty flag indicates information as to whether the cartridge 200 is in a cartridge empty state. The C_Empty flag is assigned with one of values "ON" and "OFF". The value "ON" indicates that the cartridge 200 is in the cartridge empty state. The value "OFF" indicates that the cartridge 200 is not in the cartridge empty state. The cartridge empty state refers to a state where the cartridge 200 (more specifically, the liquid chamber 210) is substantially empty of ink. In other words, the cartridge empty state refers to a state where ink does not move from the liquid chamber 210 to the liquid chamber 171 communicated with each other. In still other words, the cartridge empty state refers to a state where the surface level of ink stored in the tank 160 communicated with the cartridge 200 is lower than the predetermined level P.

The S_Empty flag indicates information as to whether the tank 160 is in an ink empty state. The S_Empty flag is assigned with one of values "ON" and "OFF". The value "ON" indicates that the tank 160 is in the ink empty state. The value "OFF" indicates that the tank 160 is not in the ink empty state. The ink empty state refers to a state where the surface level of ink stored in the tank 160 (more specifically, the liquid chamber 171) has reached proximity to the upper edge of the outlet 174. In other words, the ink empty state refers to a state where the count value SN is greater than or equal to the threshold $N_{th}$. If ink ejection is performed by the head 21 repeatedly even after the tank 160 has become in the ink empty state, the surface level of ink stored in the tank 160 may become lower than the upper edge of the outlet 174. This may cause intrusion of air into the ink channel that extends from the tank 160 to the head 21 or intrusion of air into the head 21 (i.e., air-in). Such an air-in may further cause insufficient supply of ink to each of the nozzles 29, thereby causing an ink ejection failure.

Operation of Printer 10

Referring to FIGS. 7 to 10B, an operation performed by the printer 10 according to the embodiment will be described. Each processing illustrated in FIGS. 7 to 10B may be executed by the CPU 131 of the controller 130. Each processing described below may be executed by the CPU 131 that reads the program stored in the ROM 132 or may be executed by a hardware circuit installed on the controller 130. An order in which processing steps are executed in each processing may be changed without departing from the spirit and scope of the invention.

Image Recording Processing

Figure 7:
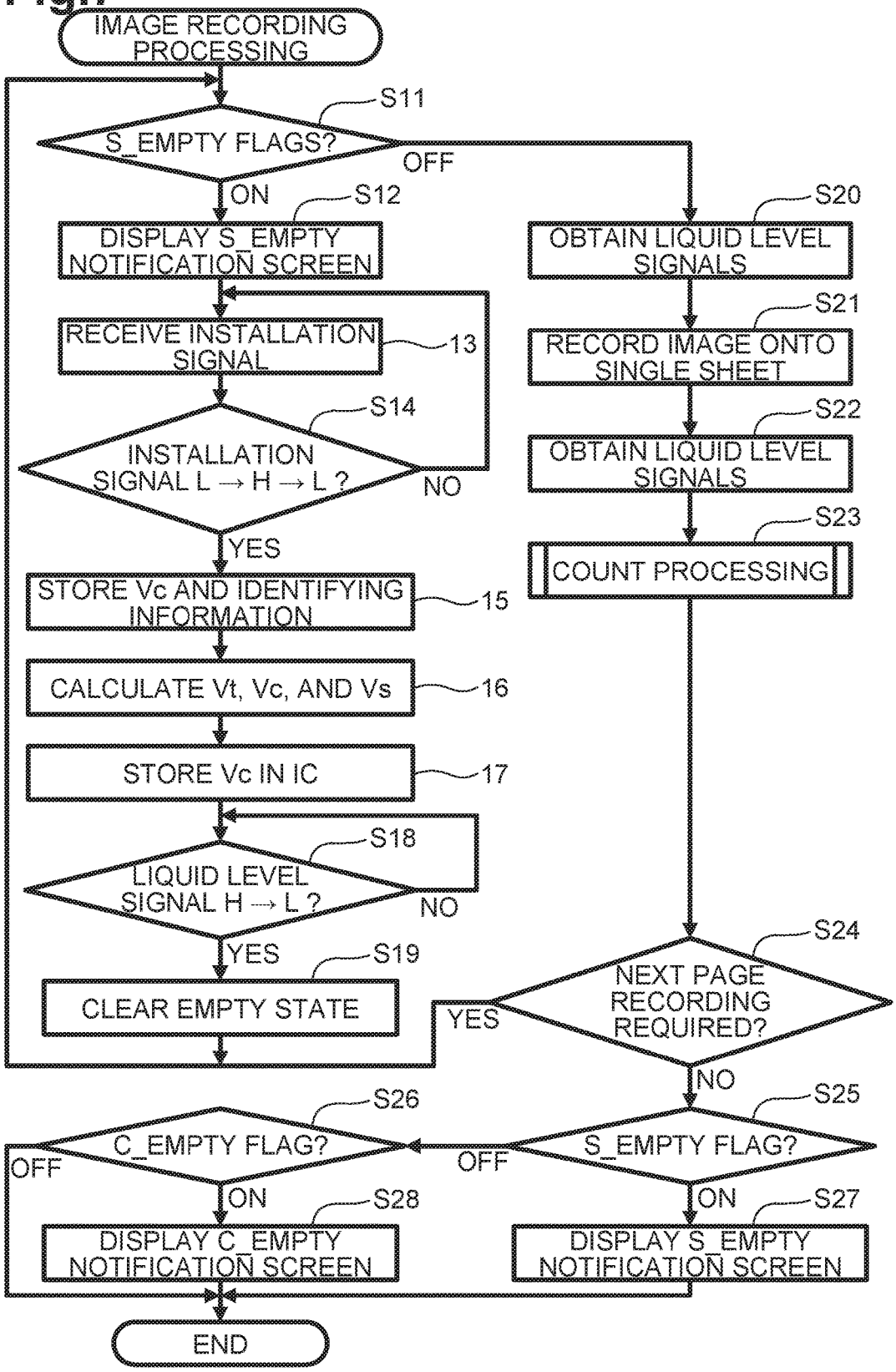
FIG. 7 is a flowchart of image recording processing.

The controller 130 is configured to, in response to input of a recording instruction to the printer 10, execute image recording processing (refer to FIG. 7). The recording instruction is an example of a first discharge instruction and an example of a second discharge instruction. The first and second discharge instructions are instructions for causing the printer 10 to execute recording processing for recording an image represented by an image data onto a sheet. A sender of the recording instruction is not limited to a particular sender. In one example, the printer 10 may receive a user operation for providing a recording instruction, via the operation panel 22. In another example, the printer 10 may receive a recording instruction via its communication interface (not illustrated) from an external device.

The controller 130 determines, with respect to each of the four S_Empty flags, which value is assigned (e.g., step S11). If the controller 130 determines that at least one of the S_Empty flags is assigned with the value "ON" (e.g., step S11:ON), the controller 130 displays an S_Empty notification screen on the display 17 (e.g., step S12). The S_Empty notification screen provides notification to the user that a tank 160 corresponding to the S_Empty flag that is assigned with the value "ON" is in the ink empty state and thus ink discharge via the head 21 cannot be performed. The S_Empty notification screen may include information indicating, for example, color of ink stored in the tank 160 having the ink empty state, and/or the ink amounts Vc and Vs. In other embodiments, for example, if the controller 130 determines that at least one of the S_Empty flags is assigned with the value "ON" (e.g., step S11:ON), in step S12, the controller 130 may display a C_Empty notification screen in addition to the S_Empty notification screen.

The controller 130 executes processing steps S13 to S19 on each of the one or more cartridges 200 whose S_Empty flags are assigned with the value "ON". That is, processing in each of steps S13 to S19 are executed on each of the one or more cartridges 200 whose S_Empty flags are assigned with "ON", among the four cartridges 200. The same processing is executed on all of the target cartridges 200 in steps S13 to S19, and therefore, a description will be provided on processing in steps S13 to S19 to be executed on one of the target cartridges 200.

Subsequent to step S12, the controller 130 receives a signal outputted by the installation sensor 154 (e.g., step S13). Subsequent to step S13, the controller 130 determines which one of the high level signal (H) and the low level signal (L) has been received from the installation sensor 154 (e.g., step S14). The controller 130 repeats steps S13 and S14 at predetermined intervals until the controller 130 determines that the signal outputted by the installation sensor 154 has changed from the low level signal (L) to the high level signal (H) and then has further changed from the high level signal (H) to the low level signal (L) again (e.g., step S14:NO). In other words, the controller 130 repeats steps S13 and S14 while the currently used cartridge 200 is detached from the installation case 150 and until a new cartridge 200 is fully attached to the installation case 150 as its replacement.

In step S14, if the controller 130 determines that the controller 130 has received the low level signal, the high level signal, and the low level signal again in this order from the installation sensor 154 (e.g., step S14:YES), the controller 130 executes step 15. That is, the controller 130 reads the identifying information and the ink amount Vc from the IC board 247 of the currently-attached cartridge 200 via the contact 152 and stores the identifying information and the ink amount Vc in the EEPROM 134 (e.g., step S15). At that time, the controller 130 overwrites the ink amount Vc currently stored in the EEPROM 134 with the newly obtained ink amount Vc.

Subsequent to step S15, the controller 130 calculates the total ink amount Vt of the post-cartridge replacement (e.g., step S16). More specifically, the controller 130 calculates the ink amount Vs of the pre-cartridge replacement based on the count value SN of the pre-cartridge replacement stored in the EEPROM 134 and the ink amount Vsc stored in the ROM 132 (Vs=Vsc−SN), and stores the obtained ink amount Vs in the EEPROM 134. The ink amount Vs of the pre-cartridge replacement is equal to the total ink amount Vt of the pre-cartridge replacement. Thereafter, the controller 130 calculates the total ink amount Vt of the post-cartridge replacement based on the obtained ink amount Vs and the ink amount Vc read from the memory of the IC board 247 of the replacement cartridge 200. That is, with the cartridge replacement, the ink amount Vc that indicates the amount of ink stored in the liquid chamber 210 of the newly attached cartridge 200 is added to the ink amount Vs (=Vsc−SN) that indicates the amount of ink stored in the liquid chamber 171 of the corresponding tank 160 immediately before the replacement cartridge 200 is attached. Therefore, the controller 130 calculates the total ink amount Vt by adding the ink amount Vc read from the IC board 247 of the replacement cartridge 200 to the ink amount Vs of the pre-cartridge replacement stored in the EEPROM 134 (Vt=Vs+Vc).

Subsequent to step S15, the controller 130 calculates, based on the obtained total ink amount Vt and an appropriate one of the functions F1 and F2 read from the EEPROM 134, the ink amount Vc and the ink amount Vs after ink movement from the liquid chamber 210 to the liquid chamber 171 is completed (e.g., step S16). In response to cartridge replacement, ink stored in the liquid chamber 210 of the newly-attached cartridge 200 flows into the liquid chamber 171 of the corresponding tank 160 via the needle 181. Thus, the ink amount Vc of ink stored in the liquid chamber 210 decreases and the ink amount Vt of ink stored in the liquid chamber 171 increases. Consequently, ink stored in the liquid chamber 210 of the cartridge 200 and ink stored in the liquid chamber 171 of the tank 160 become in equilibrium while the surface of ink stored in the liquid chamber 210 and the surface of ink stored in the liquid chamber 171 are at the same level in the top-bottom direction 7.

In step S16, the controller 130 determines whether the obtained total ink amount Vt is greater than or equal to the threshold Vh. For example, in a case where a completely new cartridge 200 is attached to the installation case 150, the obtained total ink amount Vt is greater than or equal to the threshold Vh. If the controller 130 determines that the obtained total ink amount Vt is greater than or equal to the threshold Vh, the controller 130 calculates the ink amount Vs based on the total ink amount Vt using the function F1. Further, the controller 130 calculates the ink amount Vc by subtracting the obtained ink amount Vs from the total ink amount Vt. Thereafter, the controller 130 stores the obtained ink amount Vc in the memory of the IC board 247 via the contact 152 (e.g., step S17). At that time, the controller 130 overwrites the ink amount Vc currently stored in the IC board 247 with the newly obtained ink amount Vc.

Subsequent to step S17, the controller 130 determines whether the signal received from the liquid level sensor 155 has changed from the high level signal (H) to the low level signal (L) (e.g., step S18). In response attachment of the completely new cartridge 200 to the installation case 150, ink flows from the liquid chamber 210 of the newly-attached cartridge 200 to the liquid chamber 171 of the corresponding tank 160. In response to reach of the surface level of ink stored in the liquid chamber 171 to the predetermined level P, the signal outputted by the liquid level sensor 155 changes from the high level signal to the low level signal. If the controller 130 determines that the signal received from the liquid level sensor 155 has not changed from the high level signal to the low level signal (e.g., step S18:NO), the controller 130 repeats step S18 until the controller 130 determines that the signal received from the liquid level sensor 155 has changed from the high level signal to the low level signal. That is, the controller 130 waits until the surface level of ink stored in the liquid chamber 171 rises to the predetermined level P.

If the controller 130 determines that the signal received from the liquid level sensor 155 has changed from the high level signal (H) to the low level signal (L) (e.g., step S18:YES), the controller 130 assigns the value "OFF" to each of the S_Empty flag and the C_Empty flag. Subsequent to step S18, the controller 130 closes the one or more currently displayed screens, e.g., one or both of the S_Empty notification screen and the C_Empty notification screen, from the display 17 (e.g., step S19). The controller 130 displays the obtained ink amounts Vc and Vs on the display 17. The controller 130 may also display the obtained total ink amount Vt on the display 17. The total ink amount Vt and the ink amounts Vc and Vs may be indicated by numeric values or by images such as a bar indicator. Both of the ink amount Vc and the ink amount Vs are not necessarily indicated. In one example, one of the ink amount Vc and the ink amount Vs, for example, only the ink amount Vc may be indicated. Subsequent to step S19, the controller 130 executes step S11 and the subsequent steps again.

If the controller 130 determines that none of the S_Empty flags is assigned with the value "ON", i.e., if the controller 130 determines that all of the S_Empty flags is assigned with the value "OFF" (e.g., step S11:OFF), the controller 130 obtains a signal currently outputted by each of the four liquid level sensors 155. In step S20, the controller 130 stores, in the RAM 133, information indicating one of the high level signal and the low level signal received from each of the liquid level sensors 155.

Subsequent to step S20, the controller 130 executes recording of one of one or more images represented by image data included in the recording instruction, onto a single sheet (e.g., step S21). More specifically, for example, the controller 130 controls the feed roller 23 and the conveying rollers 25 to convey one of one or more sheets supported by the feed tray 15. The controller 130 also controls the head 21 to eject ink therefrom and controls the output rollers 27 to output the sheet on which the image has been recorded, onto the output tray 16. That is, in a case where all of the four S_Empty flags are assigned with the value "OFF", the controller 130 allows the head 21 to discharge ink. On the other hand, in a case where at least one of the four S_Empty flags is assigned with the value "ON", the controller 130 prohibits ink discharge from the head 21.

In response to completion of image recording onto a single sheet in accordance with the recording instruction, the controller 130 obtains a signal currently outputted by each of the four liquid level sensors 155 (e.g., step S22). Similar to step S20, the controller 130 stores, in the RAM 133, information indicating one of the high level signal and the low level signal received from each of the installation sensors 155 (e.g., step S22). Subsequent to step S22, the controller 130 executes count processing (e.g., step S23). The count processing may be for updating the count values TN and SN, and the values of the C_Empty flag and the S_Empty flag based on the signals received from the each of the liquid level sensors 155 in steps S20 and S22. Details of the count processing will be described later with reference to FIG. 8.

Subsequent to step S23, the controller 130 repeats steps S11 to S24 until all of the one or more images represented by the image data included in the recording instruction have been recorded on respective sheets (e.g., step S24:YES). In response to completion of recording of all of the one or more images represented by the image data included in the recording instruction onto the respective sheets (e.g., step S24:NO), the controller 130 may determine, with respect to each of the four S_Empty flags and/or each of the four C_Empty flags, which value is assigned (e.g., steps S25 and S26).

More specifically, for example, if the controller 130 determines that at least one of the S_Empty flags is assigned with the value "ON" (e.g., step S25:ON), the controller 130 displays the S_Empty notification screen on the display 17 (e.g., step S27). If the controller 130 determines that all of the S_Empty flags are assigned with the value "OFF" and at least one of the C_Empty flags is assigned with the value "ON" (e.g., step S25:OFF and step S26:ON), the controller 130 displays the C_Empty notification screen on the display 17 (e.g., step S28). Steps S25 and S26 are an example of activating the alarm.

The S_Empty flag screen displayed in step S27 may be the same as the S_Empty flag screen displayed in step S12. The C_Empty notification screen provides notification to the user that the cartridge 200 corresponding to the C_Empty flag assigned with the value "ON" is in the cartridge empty state. The C_Empty notification screen may include information indicating, for example, color of ink stored in the cartridge 200 having the cartridge empty state, and/or the ink amounts Vc and Vs. If the controller 130 determines that all of the S_Empty flags are assigned with the value "OFF" and also determines that all of the C_Empty flags are assigned with the value "OFF" (e.g., step S26:OFF), the controller 130 ends the image recording processing.

Nevertheless, the discharge instruction is not limited to the recording instruction. In other embodiments, for example, the discharge instruction may be a maintenance instruction for instructing maintenance of the nozzles 29 (e.g., purging). The controller 130 is further configured to, in response to input of a maintenance instruction via the operation panel 22, execute similar processing described in FIG. 7. Nevertheless, in such a case, the following are different points from the case where the recording instruction has been received. In step S21, the controller 130 controls a maintenance mechanism (not illustrated) to perform ink discharge via the nozzles 29. Subsequent to the count processing, the controller 130 omits step S24 and executes step S25 and the subsequent steps.

Count Processing

Figure 8:
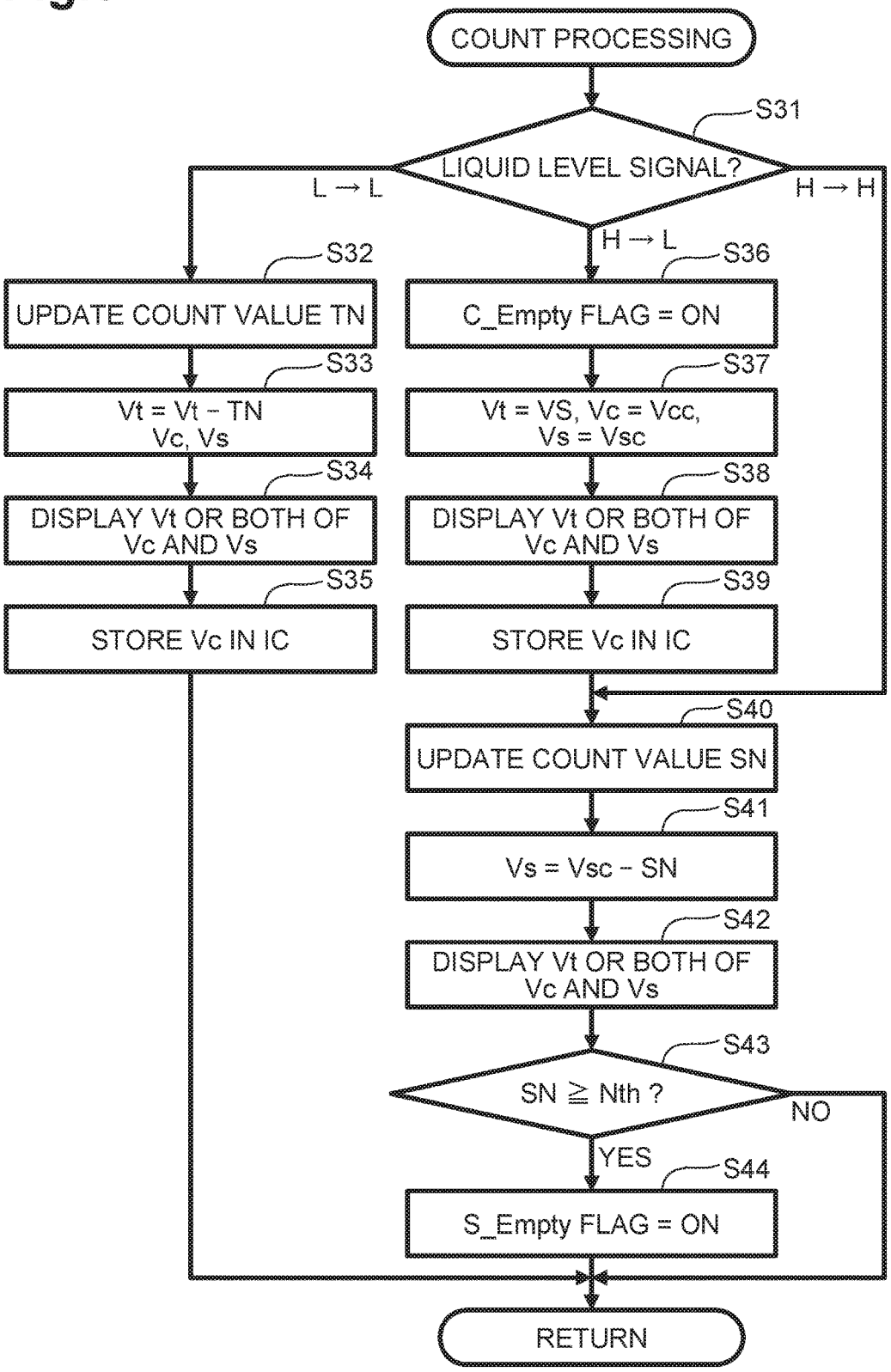
FIG. 8 is a flowchart of count processing.

Hereinafter, referring to FIG. 8, the count processing executed by the controller 130 in step S23 will be described. The controller 130 executes the count processing on the four cartridges 200 individually. Nevertheless, the same processing is executed on all of the cartridges 200, and therefore, a description will be provided with respect to the count processing to be executed on one of the cartridges 200.

The controller 130 compares the information indicating the signal received from the liquid level sensor 155 stored in the RAM 133 in step S20 with the information indicating the signal received from the liquid level sensor 155 stored in the RAM 133 in step S22 (e.g., step S31). That is, the controller 130 determines, with respect to the signal outputted by each of the liquid level sensors 155, whether the type of signal is different between before and after step S21 which was executed immediately before the count processing (e.g., step S23).

If the controller 130 determines that both of the information indicating the signal received from the liquid level sensor 155 stored in the RAM 133 in step S20 and the information indicating the signal received from the liquid level sensor 155 stored in the RAM 133 in step S22 indicate the low level signal (L) (i.e., if the controller 130 determines that the type of the signal outputted by the liquid level sensor 155 is the same between before and after step S21) (e.g., S31:L=>L), the controller 130 updates the count value TN (e.g., step S32). That is, the controller 130 adds, to the count value TN, a value corresponding to the ink amount for discharge instructed immediately before step S21.

Subsequent to step S32, the controller 130 calculates the current total ink amount Vt (e.g., step S33). More specifically, for example, the controller 130 calculates the total ink amount Vt of the post-cartridge replacement that is a sum of the ink amounts Vc and Vs stored in the EEPROM 134 after cartridge replacement. Then, the controller 130 calculates the current total ink amount Vt by subtracting the ink amount corresponding to the count value TN from the calculated total value Vt (Vt=Vt−TN). Subsequent to step S32, the controller 130 calculates, based on the obtained current total ink amount Vt and an appropriate one of the functions F1 and F2, the ink amount Vc and the ink amount Vs (e.g., step S33).

The controller 130 determines whether the obtained current total ink amount Vt is greater than or equal to the threshold Vh. If the controller 130 determines that the obtained current total ink amount Vt is greater than or equal to the threshold Vh, the controller 130 calculates the ink amount Vs based on the current total ink amount Vt using the function F1. If the controller 130 determines that the obtained current total ink amount Vt is less than the threshold Vh, the controller 130 calculates the ink amount Vs based on the current total ink amount Vt using the function F2. The controller 130 then calculates the ink amount Vc by subtracting the obtained ink amount Vs from the current total ink amount Vt.

Subsequent to step S33, the controller 130 displays both of the obtained ink amounts Vc and Vs or the obtained total ink amount Vt on the display 17 (e.g., step S34). Subsequent to step S34, the controller 130 overwrites the ink amount Vc currently stored in the IC board 247 of the cartridge 200 with the newly obtained ink amount Vc (e.g., step S35).

Figure 10A:
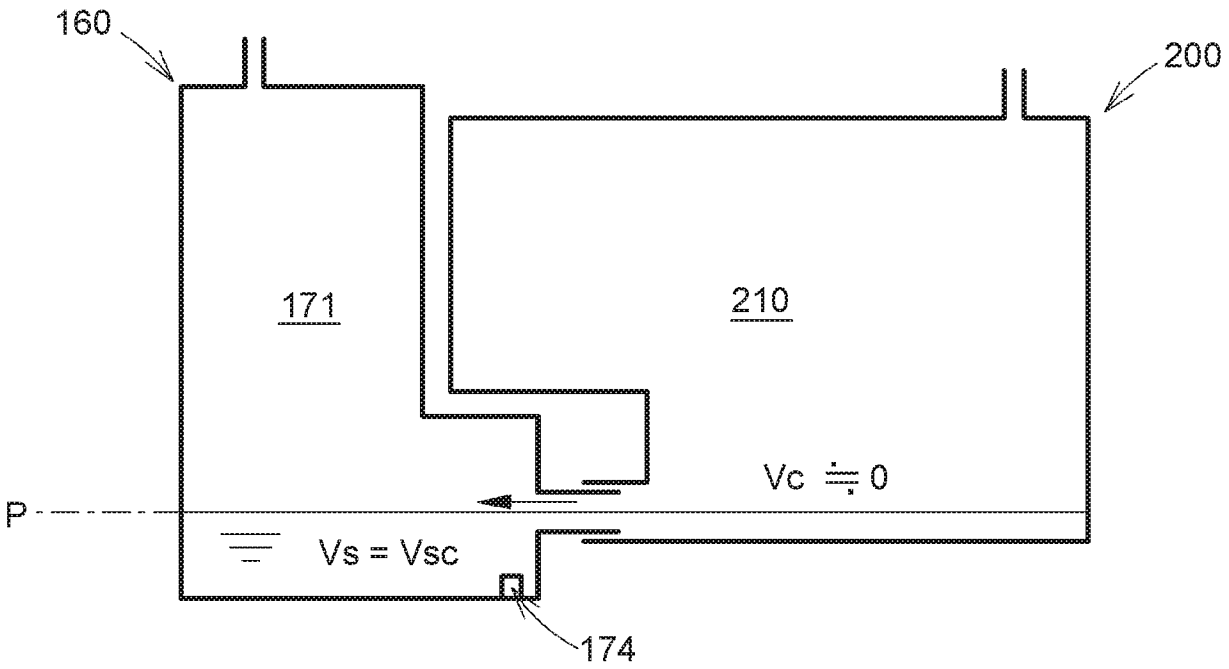
FIG. 10A is a schematic view illustrating a state where a tank and the cartridge are in communication with each other, wherein the cartridge is in a cartridge empty state.

If the controller 130 determines that the information stored in the RAM 133 in step S20 indicates the low level signal (L) and the information stored in the RAM 133 in step S22 indicates the high level signal (H) (i.e., if the controller 130 determines that the type of the signal outputted by the liquid level sensor 155 is different between before and after step S21) (e.g., step S31:L=>H), the controller 130 assigns the value "ON" to the C_Empty flag (e.g., step S36). The occurrence of such change of the signal outputted by the liquid level sensor 155 corresponds to arrival of the surface level of ink stored in the liquid level 171 at the predetermined level P during execution of step S21 as illustrated in FIG. 10A. From then on, ink does not move between the cartridge 200 and the tank 160.

Subsequent to step S36, the controller 130 reads the predetermined ink amount Vcc (=0) from the ROM 132 and assigns the predetermined ink amount Vcc to the ink amount Vc (e.g., step S37). Similarly, the controller 130 reads the predetermined ink amount Vsc (corresponding to the volume of a portion of the liquid chamber 171 between the upper edge of the outlet 174 and the surface of ink lower than the predetermined level P) from the ROM 132 and assigns the predetermined ink amount Vsc to the ink amount Vc (e.g., step S37). The obtained ink amounts Vc and Vs include errors. Therefore, the controller 130 resets the accumulated errors by assigning the predetermined ink amount Vcc and the predetermined ink amount Vsc to the ink amount Vc and the ink amount Vs, respectively, at the timing at which the signal outputted by the liquid level sensor 155 changes from the low level signal to the high level signal. Subsequent to step S36, the controller 130 calculates the current total ink amount Vt as the same value as the ink amount Vs (Vt=Vsc) (e.g., step S37). When the ink amount Vc becomes 0 (zero), the total ink amount Vt becomes the same amount as the ink amount Vs.

Subsequent to this, the controller 130 displays both of the current ink amounts Vc and Vs or the current total ink amount Vt on the display 17 (e.g., step S38). Subsequent to step S38, the controller 130 overwrites the ink amount Vc currently stored in the IC board 247 of the cartridge 200 with the newly obtained ink amount Vc (=0) (e.g., step S39).

The signal outputted by the liquid level sensor 155 may change during execution of step S21. Therefore, the predetermined ink amount Vsc read in step S37 indicates the ink amount immediately prior to occurrence of the change of the signal outputted by the liquid level sensor 155 but not the ink amount stored in the tank 160 at the moment when the signal outputted by the liquid level sensor 155 changes. Nevertheless, there is only a slight difference in those ink amounts. Therefore, the predetermined ink amount Vsc read in step S37 may be approximately treated as the ink amount Vs at the moment when the signal outputted by the liquid level sensor 155 changes.

Subsequent to step S39, the controller 130 adds, to the count value SN stored in the EEPROM 134, a value corresponding to the ink amount for discharge instructed immediately before step S21 (e.g., step S40). If the controller 130 determines that the signal received from the liquid level sensor 155 has changed from the low level signal (L) to the high level signal (H), the controller 130 starts updating the count value SN. Further, the controller 130 adds, to the count value TN stored in the EEPROM 134, the value corresponding to the ink amount for discharge instructed immediately before step S21 (e.g., step S40).

Subsequent to step S40, the controller 130 calculates the ink amount Vs (e.g., step S41). The ink amount Vs obtained in step S41 may be calculated by a subtraction of the ink amount corresponding to the count value SN stored in the EEPROM 134 from the predetermined ink amount Vsc stored in the ROM 132. As described above, after the signal outputted by the liquid level sensor 155 changes to the high level signal, the ink amount Vs has the same value as the current total ink amount Vt. The ink amount Vc is equal to zero.

Subsequent to step S41, the controller 130 displays both of the obtained current ink amounts Vc and Vs or the obtained current total ink amount Vt on the display 17 (e.g., step S42). After the signal outputted by the liquid level sensor 155 changes to the high level signal, the ink amount Vc is equal to zero. Therefore, the controller 130 does not overwrite the ink amount Vc currently stored in the IC board 247 of the cartridge 200 with the newly obtained ink amount Vc.

Subsequent to step S42, the controller 130 compares the count value SN updated in step S40 and the threshold $N_{th}$ (e.g., step S43). If the controller 130 determines that the count value SN updated in step S40 is less than the threshold $N_{th}$ (e.g., step S43:NO), the controller 130 ends the count processing. If the controller 130 determines that the count value SN updated in step S40 is greater than or equal to the threshold $N_{th}$ (e.g., step S43:YES), the controller 130 assigns the value "ON" to the S_Empty flag (e.g., step S44). Thereafter, the controller 130 determines that at least one of the S_Empty flags is assigned with the value "ON", the controller 130 prohibits ink discharge from the head 21.

If the controller 130 determines that both of the information indicating the signal received from the liquid level sensor 155 stored in the RAM 133 in step S20 and the information indicating the signal received from the liquid level sensor 155 stored in the RAM 133 in step S22 indicate the high level signal (L) (e.g., step S31:H=>H), the controller 130 reads the count value SN stored in the EEPROM 134. Thereafter, the controller 130 adds, to the read count value SN, the value corresponding the ink amount for discharge instructed immediately before step S21, and stores the updated count value SN in the EEPROM 134. That is, the controller 130 updates the count value SN (e.g., step S40). The controller 130 also updates the count value TN. Subsequent to step S40, the controller 130 executes steps S41 to S44 using the count value SN updated in step S40.

Effects

According to the above-described embodiment, the controller 130 may determine the ink amount Vs and the ink amount Vc based on the current total ink amount Vt. The controller 130 calculates the ink amount Vs based on the current total ink amount Vt using an appropriate one of the functions F1 and F2. Therefore, the controller 130 may calculate the ink amount Vs accurately.

The controller 130 assigns the predetermined ink amount Vsc to the current total ink amount Vt at the timing at which the signal outputted by the liquid level sensor 155 changes from the low level signal to the high level signal. Therefore, the total ink amount Vt in which the errors in the count value TN have been corrected may be obtained. The controller 130 calculates the current total ink amount Vt as the same value as the ink amount Vs. Therefore, after the ink amount Vc becomes zero, the ink amount Vs may be calculated accurately.

The calculated ink amount Vc is stored in the IC board 27. Therefore, in a case where the currently used cartridge 200 is detached from the installation case 150 of the printer 10 and is then attached to and used in another printer 10, the another printer 10 may read the ink amount Vc of the cartridge 200.

In response to cartridge replacement, the controller 130 calculates the total ink amount Vt of the post-cartridge replacement based on the ink amount Vc read from the IC board 247 and the ink amount Vs obtained based on the predetermined amount Vsc and the count value SN. Therefore, the controller 130 may calculate the total ink amount Vt accurately in both cases where a completely new cartridge 200 is attached to the installation case 150 and where a used cartridge 200 from which some of ink was consumed is attached to the installation case 150.

The controller 130 displays at least one of the calculated total ink amount Vt, the ink amount Vc, and the ink amount Vs on the display 17. Therefore, the user may be notified of at least one of the total ink amount Vt, the ink amount Vc, and the ink amount Vs.

First Alternative Embodiment

In the above-described embodiment, the installation case 150 allows the cartridges 200 of the same type to be attached thereto. Nevertheless, the installation case 150 may allow cartridges 200 of different types to be attached thereto. In such a case, the cartridges 200 include liquid chambers 210 having different capacity. The liquid chambers 210 of such cartridges 200 have different sectional areas. The ink amount Vc of ink initially stored in the liquid chamber 210 of each of the cartridges 200, i.e., the initial ink amount Vc0, is different from each other. For example, the installation case 150 may allow attachment of the cartridge 200 according to the above-described embodiment (an example of a first-type cartridge) and a large capacity cartridge that may initially store a larger amount of ink than the cartridge 200 (e.g., an example of a second-type cartridge).

The IC board 247 of each of the cartridges 200 stores type information indicating the cartridge type. The EEPROM 134 stores a plurality of pairs of functions F1 and F2. The pairs of functions F1 and F2 correspond to the respective cartridge types. In step S15 of the image recording processing, the controller 130 selects an appropriate pair of function F1 and F2 from the EEPROM 134 based on the type information read from the IC board 247 of the cartridge 200 attached to the installation case 150. In step S16, the controller 130 calculates the ink amounts Vc and Vs based on the current total ink amount Vt using an appropriate one of functions F1 and F2 included in the selected pair. Therefore, the controller 130 may calculate the ink amounts Vc and Vs accurately based on the current total ink amount Vt with respect to each of the cartridges 200 of the different types.

Second Alternative Embodiment

Figure 10B:
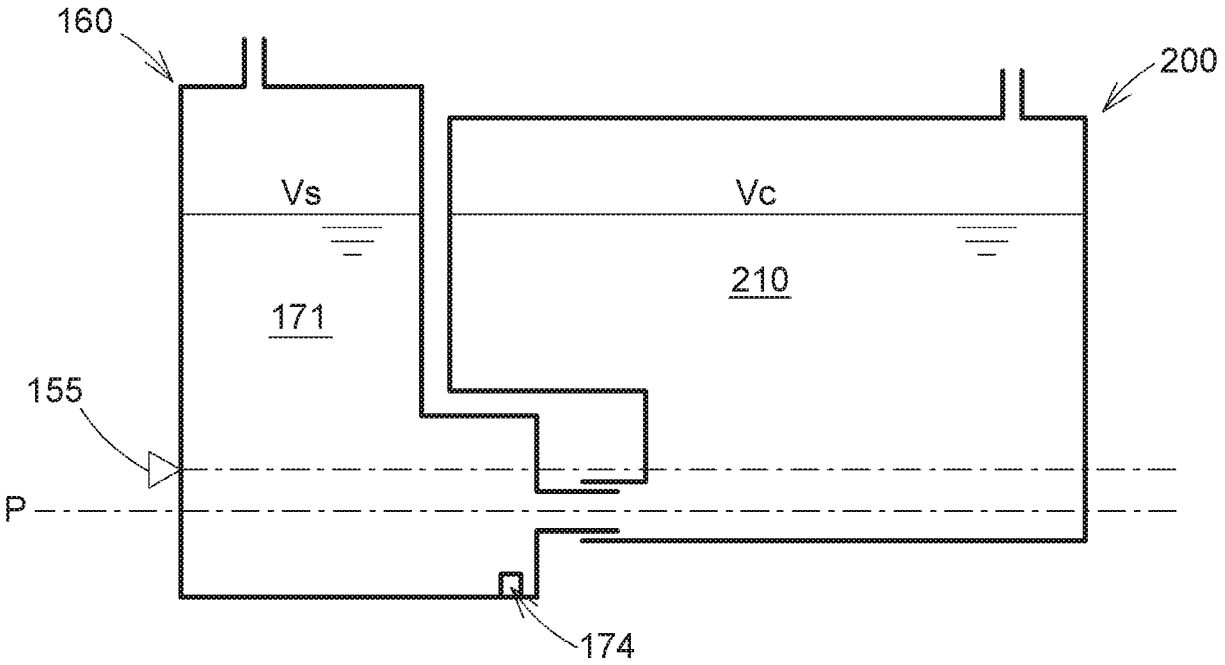
FIG. 10B is a schematic view illustrating a state where the tank and the cartridge are in communication with each other and illustrates a detecting position of a liquid level sensor according to a second alternative embodiment.

In the above-described embodiment, the controller 130 detects the surface of ink at the predetermined level P in the liquid chamber 171, based on the signal outputted by the liquid level sensor 155. Nevertheless, in the second alternative embodiment, as illustrated in FIG. 10B, the controller 130 may detect the surface of ink at a detecting position higher than the predetermined level P, based on the signal outputted by the liquid level sensor 155.

When the controller 130 detects the surface of ink at the detecting position higher than the predetermined level P, based on the signal outputted by the liquid level sensor 155, ink is still stored in both of the liquid chamber 210 of the cartridge 200 and the liquid chamber 171 of the tank 160. In the count processing, the controller 130 starts update of the count value SN without executing steps S36 to S39 (e.g., step S40). Similar to steps S32 to S35, the controller 130 calculates the ink amounts Vc and Vs based on the current total ink amount Vt and stores the obtained ink amount Vc in the IC board 247 of the memory.

If the controller 130 determines that the count value SN has reached a threshold Np1 (an example of a second threshold), the controller 130 executes steps S36 to S39. The threshold Np1 corresponds to an ink amount required until the surface of ink stored in the liquid chamber 171 of the tank 160 reaches the predetermined level P after the controller 130 detects the surface of ink at the detecting position higher than the predetermined level P based on the signal outputted by the liquid level sensor 155. Subsequent to this, the controller 130 executes steps S41 to S44 using the updated count value SN.

If the controller 130 determines that the count value SN has reached a threshold Np2 (an example of a third threshold), the controller 130 may display a screen notifying that the cartridge 200 is nearly in the cartridge empty (C_Empty) state, on the display 17. The threshold Np2 may be smaller than the threshold Np1. The threshold Np2 corresponds to an ink amount required until the surface of ink stored in the liquid chamber 171 of the tank 160 reaches a position slightly higher than the predetermined level P after the controller 130 detects the surface of ink at the detecting position higher than the predetermined level P based on the signal outputted by the liquid level sensor 155. Therefore, notification may be provided to the user that the liquid chamber 210 of the cartridge 200 becomes empty of ink soon.

Other Alternative Embodiments

In the above-described embodiment, the ink amount Vs is calculated based on the current total ink amount Vt using an appropriate one of the functions F1 and F2. Nevertheless, in other embodiments, for example, the ink amount Vc may be calculated based on the current total ink amount Vt using a function that approximately expresses a relationship between the current total ink amount Vt and the ink amount Vc, and the obtained ink amount Vc may be subtracted from the current total ink amount Vt to obtain the ink amount Vs.

In the above-described embodiment, the functions F1 and F2 are stored in the EEPROM 134. Nevertheless, in other embodiments, for example, the functions F1 and F2 may be stored in the memory of the IC board 247 of the cartridge 200. In such a case, the controller 130 may read the type information and the functions F1 and F2 from the IC board 247 of the cartridge 200 attached to the installation case 150 and the read functions F1 and F2 may be used as the functions F1 and F2 corresponding to the cartridge 200. As substitutes for the functions F1 and F2, a table that shows a correspondence between the current total ink amount Vt, the ink amount Vc, and the ink amount Vs may be stored in the IC board 247 or the EEPROM 134. In such a case, after the current total ink amount Vt is determined, the ink amount Vc and the ink amount Vs may be determined based on the table.

In the above-described embodiment, the controller 130 stores the total ink amount Vt of the post-cartridge replacement in the EEPROM 134 and obtains the current total ink amount Vt by subtracting the ink amount corresponding to the count value TN from the total ink amount Vt. Nevertheless, in other embodiments, for example, the controller 130 may update the total ink amount Vt every time ink discharge from the head 21 is performed, and store the updated total ink amount Vt in the EEPROM 134. In response to performance of the next ink discharge from the head 21, the controller 130 calculates the amount of ink ejected in the ink discharge based on the count value TN and update the total ink amount Vt by subtracting the amount of ink used in the ink discharge from the total ink amount Vt stored in the EEPROM 134.

In the above-described embodiment, if the controller 130 determines that the controller 130 has received the low level signal, the high level signal, and the low level signal in this order from the installation sensor 154 (e.g., step S14:YES), the controller 130 executes step 15. That is, in response to attachment of a cartridge 200 to a corresponding empty space of the installation case 150, the controller executes step S15. In other words, if the controller 130 determines that attachment of a cartridge 200 to a corresponding empty space of the installation case 150 has been completed, the controller 130 may execute step S15. Determining that the controller 130 has received the low level signal, the high level signal, and the low level signal in this order from the installation sensor 154 is an example of determining that attachment of a cartridge to the installation case 150 has been completed. Another example of determining that attachment of a cartridge 200 to the installation case 150 has been completed will be described.

In one example, the controller 130 receives the low level signal after receiving the high level signal from the cover sensor 88. Then, the controller 130 reads the identifying information from the memory of the IC board 247 of the newly-attached cartridge 200 and compares the read identifying information of the newly-attached cartridge 200 with the identifying information of the previously-used cartridge 200 stored in the EEPROM 134. If the controller 130 determines that the identifying information read from the memory of the IC board 247 is different from the identifying information stored in the EEPROM 134, the controller 130 may execute step S15. That is, the disclosure "the controller 130 reads the identifying information from the memory of the IC board 247 of the newly-attached cartridge 200 and compares the read identifying information with the identifying information of the previously-used cartridge 200 stored in the EEPROM 134. As a comparison result, the controller 130 determines that the identifying information read from the memory of the IC board 247 is different from the identifying information stored in the EEPROM 134." is another example of determining that attachment of a cartridge 200 to the installation case 150 has been completed.

In another example, the controller 130 may receive the low level signal after receiving the high level signal from the cover sensor 88. The controller 130 may display, on the display 17, a confirmation screen asking the user whether attachment of a cartridge 200 to the installation case 150 has been completed. While the controller 130 displays the confirmation screen on the display 17, the controller 130 may receive an input onto the confirmation screen via the operation panel 22. If the controller 130 determines that the received input corresponds to completion of the attachment of a cartridge 200 to the installation case 150, the controller may execute step S15. That is, the disclosure "the controller 130 receives the low level signal after receiving the high level signal from the cover sensor 88. The controller 130 displays, on the display 17, a confirmation screen asking the user whether attachment of a cartridge 200 to the installation case 150 has been completed. While the controller 130 displays the confirmation screen on the display 17, the controller 130 receives an input onto the confirmation screen via the operation panel 22. The received input corresponds to completion of the attachment of a cartridge 200 to the installation case 150" is another example of determining that attachment of a cartridge 200 to the installation case 150 has been completed.

In the above-described embodiment, the controller 130 determines, based on the type of the signal outputted by the liquid level sensor 155, whether the detector portion 194 of the actuator 190 is located at the detected position. Nevertheless, the configuration of the liquid level sensor 155 is not limited to the specific example if the liquid level sensor 155 can detect the surface level of ink stored in the liquid chamber 171. In one example, the liquid level sensor 155 may be a sensor configured to optically detect the surface level of ink stored in the liquid chamber 171 using prisms having different reflectivity depending on whether ink contacts the rear wall 164 of the liquid chamber 171. In another example, the surface level of the ink stored in the liquid chamber 171 may be detected by an electrode. In still another example, the liquid level sensor 155 may be configured to output different signals depending on the surface level of ink stored in the liquid chamber 210 of the cartridge 200, instead of being configured to output different signals depending on the surface level of ink stored in the liquid chamber 171 of the tank 160.

In the above-described embodiment, the printer 10 includes the installation sensors 154 and the liquid level sensors 155. Nevertheless, the installation sensors 154 and the liquid level sensors 155 are not necessarily provided. For example, if the printer 10 does not include any liquid level sensor 155, the controller 130 may omit step S31 in the count processing, and execute steps S32 to S35 to calculate the total ink amount Vt, the ink amount Vc, and the ink amount Vs. In response to reach of the count value TN to a predetermined threshold, the controller 130 may update the C_Empty flag and the S_Empty flag.

In the above-described embodiment, if the controller 130 determines that at least one of the S_Empty flags is assigned with the value "ON", the controller 130 prohibits ink discharge from the head 21. Nevertheless, in such a case, ink discharge from the head 21 is not necessarily always prohibited. For example, in other embodiments, the controller 130 may display the S_Empty notification screen on the display 17 but not prohibit ink discharge from the head 21.

The IC board 247 is configured to contact the contact 152 to be electrically continuous to the contact 152. Nevertheless, in other embodiments, for example, an information medium and an interface may be used instead. In such a case, data may be written and read using radio waves such as Near Field Communication ("NFC") or Radio Frequency Identification.

In the above-described embodiment, ink is an example of the liquid. Nevertheless, in other embodiments, for example, the liquid may be a pre-treatment liquid that may be ejected onto a sheet prior to ink ejection or water that may be used for cleaning the head 21.

What is claimed is:

1. A liquid discharge apparatus comprising:

an installation case configured to be attached to a cartridge;

a tank including a chamber, the tank further including:

a first channel including one end in fluid communication with an outside of the tank and an opposite end in fluid communication with the chamber, wherein the first channel is configured to form at least a portion of a channel providing fluid communication between a cartridge chamber of the cartridge and the chamber when the cartridge is attached to the installation case;

a second channel including one end positioned below the first channel and in fluid communication with the chamber; and a third channel including one end in fluid communication with the chamber and the other end communicated with the outside of the tank;

a head in fluid communication with an opposite end of the second channel from the one end;

a memory; and a controller configured to:

receive a first discharge instruction for discharging liquid through the head;

update a first count value by a value corresponding to a liquid amount instructed by the first discharge instruction;

calculate a total liquid amount Vt by subtracting the first count value from an initial total liquid amount Vt, the initial total liquid amount Vt corresponding to a sum of a liquid amount Vc in a cartridge chamber and a liquid amount Vs in the chamber;

read correlated information from the memory, the correlated information indicating a correspondence among a total liquid amount Vt and one of the liquid amount Vc and the liquid amount Vs; and based on the updated total liquid amount Vt and the read correlated information, determine the liquid amount Vc and the liquid amount Vs.

2. The liquid discharge apparatus of claim 1, wherein the controller is configured to:

read a first function corresponding to the correlated information from the memory; and based on the updated total liquid amount Vt and the read first function, determine one of the liquid amount Vc and the liquid amount Vs.

3. The liquid discharge apparatus of claim 2, wherein the controller is configured to:

based on the updated total liquid amount Vt and the first function, calculate the liquid amount Vs; and calculate the liquid amount Vc by subtracting the updated total liquid amount Vt from the calculated liquid amount Vs.

4. The liquid discharge apparatus of claim 2, wherein the controller is configured to:

based on the updated total liquid amount Vt being lower than a first threshold, read a second function from the memory, the second function corresponding to the correlated information and being different from the first function; and based on the updated total liquid amount Vt and the second function, determine one of the liquid amount Vc and the liquid amount Vs.

5. The liquid discharge apparatus of claim 4, wherein the controller is configured to:

based on the updated total liquid amount Vt being lower than the first threshold, calculate the liquid amount Vs based on the updated total liquid amount Vt and the read second function;

read a second function from the memory, the second function corresponding to the correlated information and being different from the first function; and calculate the liquid amount Vc by subtracting the calculated liquid amount Vs from the updated total liquid amount Vt.

6. The liquid discharge apparatus of claim 2, further comprising the cartridge, the cartridge having a cartridge chamber, and wherein:

the cartridge chamber includes a first portion and a second portion partitioned from the first portion by a wall; and the first threshold indicates a value corresponding to the updated total ink amount Vt such that a surface of liquid in the first chamber of the cartridge contacts a first surface of the wall or a second surface of the wall, the first surface of the wall partially defining the first portion of the first chamber, the second surface of the wall partially defining the second portion of the first chamber.

7. The liquid discharge apparatus of claim 2, wherein the installation case is configured to be attached one of a first-type cartridge or a second-type cartridge, wherein the controller is configured to:

read type information of an attached cartridge indicating the attached cartridge as being one of the first-type cartridge and the second-type cartridge;

based on the read type information, select one of the first function for the read type information indicating the first type and the first function for the read type information indicating the second type from the memory; and based on the updated total liquid amount Vt and the selected first function, determine the liquid amount Vc and the liquid amount Vs.

8. The liquid discharge apparatus of claim 7, wherein the controller is configured to read the type information from a memory of the attached cartridge.

9. The liquid discharge apparatus of claim 7, wherein the controller is configured to:

based on the updated total liquid amount Vt and the selected first function, calculate the liquid amount Vs; and calculate the liquid amount Vc by subtracting the calculated liquid amount Vs from the updated total liquid amount Vt.

10. The liquid discharge apparatus of claim 1, further comprising a liquid level sensor;

wherein the controller is configured to:

receive a first signal from the liquid level sensor, the first signal outputted from the liquid level sensor in response to a surface level of liquid in the second chamber higher than or equal to the predetermined level P;

receive a second signal from the liquid level sensor, the second signal outputted from the liquid level sensor in response to the surface level of liquid in the second chamber lower than the predetermined level P; and in response to the receipt of the second signal after receipt of the first signal, setting the updated total liquid amount Vt to a predetermined amount.

11. The liquid discharge apparatus of claim 10, wherein the controller is configured to:

after setting the updated total liquid amount Vt to the predetermined amount, receive second discharge instruction for discharging liquid through the head;

update a second count value by a value corresponding to a liquid amount instructed by the second discharge instruction; and calculate the liquid amount Vs by subtracting the second count value from a liquid amount Vs based on the updated total liquid amount Vt.

12. The liquid discharge apparatus of claim 10, wherein the predetermined level P is lower than or equal to an imaginary line along the horizontal direction, the imaginary line extending through the cfirst channel.

13. The liquid discharge apparatus of claim 11, wherein:

the predetermined level P is higher than an imaginary line along the horizontal direction, the imaginary line extending through the first channel; and the controller is configured to, based on the second count value having reached a second threshold, calculate the liquid amount Vs by subtracting the second count value from a liquid amount Vs based on the updated total liquid amount Vt.

14. The liquid discharge apparatus of claim 10, further comprising an alarm;

wherein the controller is configured to, based on the second count value having reached a third threshold smaller than the second threshold, activate the alarm.

15. The liquid discharge apparatus of claim 1, further comprising an interface, wherein the controller is configured to store the determined liquid amount Vc in a memory of the attached cartridge through the interface.

16. The liquid discharge apparatus of claim 15, wherein the controller is configured to:

determine that the cartridge is attached to the installation case;

in response to the determination that the cartridge is attached to the installation case, read the liquid amount Vc from the memory of the attached cartridge through the interface; and based on the read liquid amount Vc from the memory of the attached cartridge and the liquid amount Vs before determining that the cartridge is attached to the installation case, calculate the updated total liquid amount Vt.

17. The liquid discharge apparatus of claim 1, further comprising a display, wherein the controller is configured to control the display to display the determined liquid amount Vc and the determined liquid amount Vs.

* * * * *